US010167114B2

(12) United States Patent
Casey

(10) Patent No.: US 10,167,114 B2
(45) Date of Patent: Jan. 1, 2019

(54) CONFIGURABLE CONTAINER-SUPPORT FRAME

(71) Applicant: Tigerback Enterprises, LLC, Fort Worth, TX (US)

(72) Inventor: Scott C. Casey, Fort Worth, TX (US)

(73) Assignee: Tigerback Enterprises, LLC, Fort Worth, TX (US)

( * ) Notice: Subject to any disclaimer, the term of this patent is extended or adjusted under 35 U.S.C. 154(b) by 0 days.

(21) Appl. No.: 15/378,694

(22) Filed: Dec. 14, 2016

(65) Prior Publication Data

US 2017/0174393 A1 Jun. 22, 2017

Related U.S. Application Data

(60) Provisional application No. 62/268,566, filed on Dec. 17, 2015.

(51) Int. Cl.

| | |
|---|---|
| ***E04D 13/18*** | (2018.01) |
| ***B65D 21/08*** | (2006.01) |
| ***A63B 55/00*** | (2015.01) |
| ***B65D 25/02*** | (2006.01) |
| ***B65D 5/44*** | (2006.01) |

(52) U.S. Cl.

CPC ..... *B65D 21/086* (2013.01); *A63B 55/00* (2013.01); *B65D 5/441* (2013.01); *B65D 25/02* (2013.01)

(58) Field of Classification Search

CPC .. B65D 21/086; Y10S 215/90; Y10S 220/907
USPC ..... 248/188.5, 161, 407; 220/666
See application file for complete search history.

(56) References Cited

U.S. PATENT DOCUMENTS

| | | | | |
|---|---|---|---|---|
| 1,507,977 | A | 9/1924 | Schaefer | |
| 2,475,961 | A | 7/1949 | Hilbert | |
| 2,623,565 | A | 12/1952 | Unthank | |
| 4,036,361 | A | 7/1977 | Jacobson et al. | |
| 5,333,731 | A | 8/1994 | McCuaig | |
| 5,462,380 | A * | 10/1995 | Peek | A61G 5/12 285/308 |
| 6,217,042 | B1 | 4/2001 | Kurtz et al. | |
| 6,227,397 | B1 | 5/2001 | Kim | |
| 6,334,543 | B1 | 1/2002 | Abbondandolo | |
| 6,691,885 | B2 * | 2/2004 | Brown | B65D 19/12 220/1.5 |
| 6,901,979 | B1 | 6/2005 | Herold | |
| 7,188,714 | B1 | 3/2007 | Herold | |
| 7,219,902 | B1 | 5/2007 | Herold | |

(Continued)

*Primary Examiner* — Steven M Marsh
(74) *Attorney, Agent, or Firm* — D. Tiller Law PLLC; Don Tiller

(57) ABSTRACT

A configurable container-support frame is disclosed. The frame includes at least two sections, each section including at least three substantially parallel telescoping members, each connected to two other members by a cross member that is substantially perpendicular to the telescoping members. The telescoping members of one section telescopically engage with the telescoping members of at least one other section and the engaged sections define a configurable volume. The frame may be disposed within an existing container, such as a bag or a box, to improve the protective capabilities of that container. Or the frame may be integrated with a surface, such as a fabric, to create a configurable container with improved protective capabilities over the surface alone.

10 Claims, 26 Drawing Sheets

(56) References Cited

U.S. PATENT DOCUMENTS

| | | | | |
|---|---|---|---|---|
| 7,392,888 | B2 | 7/2008 | Lai | |
| 7,708,160 | B2 | 5/2010 | Booth et al. | |
| 7,802,526 | B2 * | 9/2010 | Brady | B65D 19/12 108/53.5 |
| 7,849,984 | B2 | 12/2010 | Whalen et al. | |
| 8,016,145 | B2 | 9/2011 | Perkins | |
| 8,857,702 | B2 | 10/2014 | Hui | |
| 8,936,140 | B2 | 1/2015 | Herold | |
| 8,960,468 | B2 | 2/2015 | Boivin | |
| 9,044,082 | B2 | 6/2015 | Kusuma et al. | |
| 9,278,246 | B2 * | 3/2016 | Tambornino | A63B 21/078 |
| 9,334,079 | B2 * | 5/2016 | Lindstrom | B65D 1/34 |
| 9,580,236 | B1 * | 2/2017 | Skeid | B65D 19/08 |
| 9,605,442 | B2 * | 3/2017 | Xie | E04H 15/34 |
| 2004/0026281 | A1 | 2/2004 | Boardman et al. | |
| 2005/0279816 | A1 | 12/2005 | Kao | |
| 2006/0185999 | A1 | 8/2006 | Keays | |
| 2011/0248040 | A1 | 10/2011 | McGregor | |

* cited by examiner

FIG. 11a
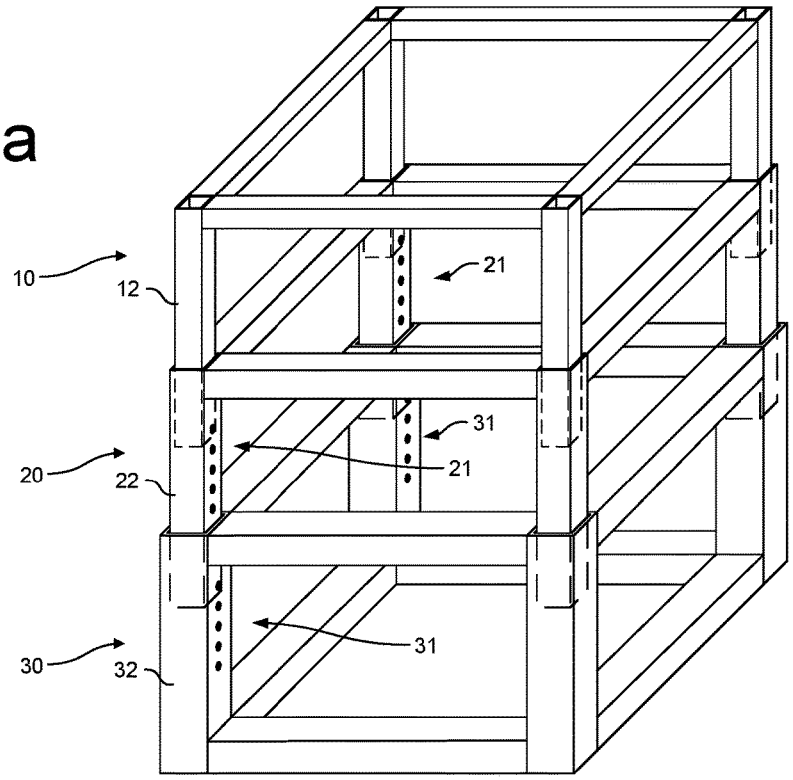
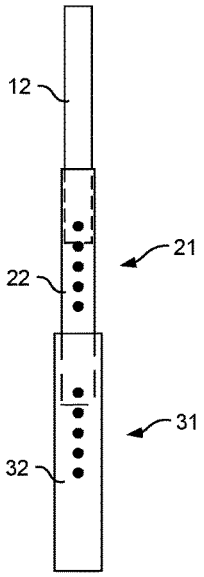
FIG. 11b
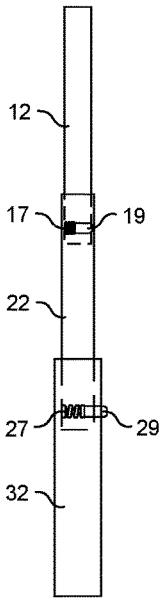
FIG. 11c

FIG. 14a
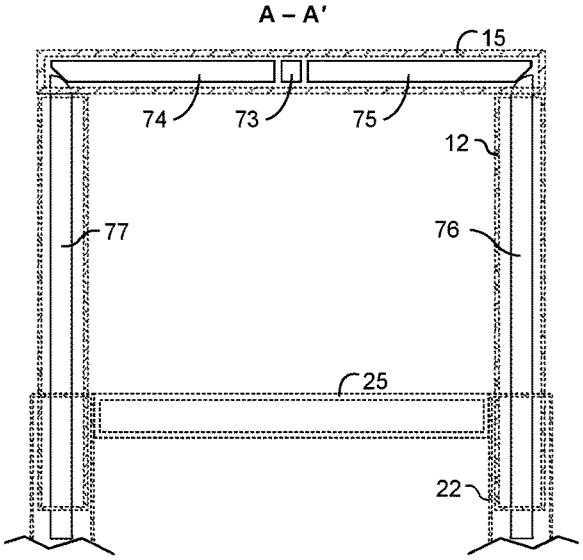
FIG. 14b
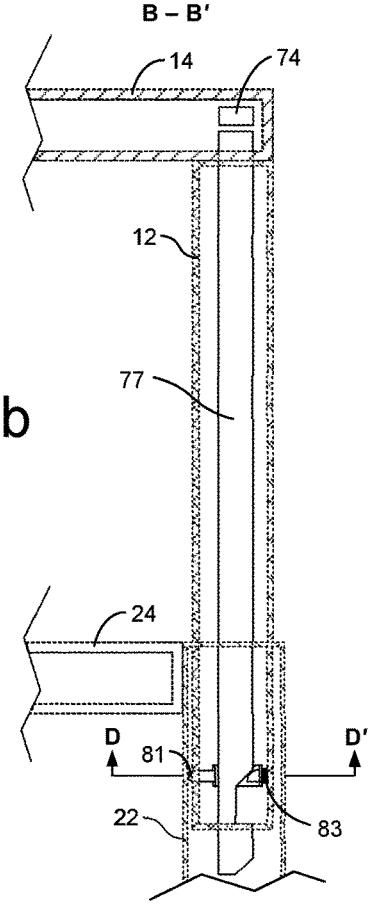
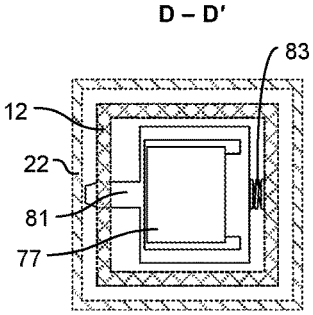
FIG. 14c

DETAIL X

DETAIL Y

DETAIL Z

CONFIGURABLE CONTAINER-SUPPORT FRAME

CROSS-REFERENCE TO RELATED APPLICATIONS

This application claims the benefit of U.S. Provisional Application No. 62/268,566, filed on Dec. 17, 2015, the entirety of which is hereby incorporated by reference.

BACKGROUND

This invention generally pertains to systems and methods for collapsible storage and transport containers. More specifically, it pertains to a collapsible support frame that may be integrated into a container design or that may be added to an existing container in order to increase the strength of the container. For instance, the invention is useful to incorporate into a soft-sided golf travel bag to provide adequate protection for the clubs while maintaining a form that is not unnecessarily heavy and that is useful as a container while in a collapsed configuration.

The use of containers to protect items while in storage or in transit is well known. Typically, the container includes a surface that defines a volume within which items may be disposed. For example, a cardboard box may have sides, a bottom, and a top that define a cube-shaped inner volume in which items may be disposed and protected by the cardboard forming the sides, bottom, and top. Such a box is useful for storing or shipping items while affording some level of protection to the items. See, e.g., U.S. Patent Application Publication No. 2005/0279816 and U.S. Pat. No. 8,857,702. Another familiar example is a suitcase. A suitcase may have surfaces comprising fabric or plastic that define an inner volume in which items may be disposed and protected by the fabric or plastic outer surface. Such a suitcase is useful for storing or shipping items while affording some level of protection to the items. See, e.g., U.S. Pat. No. 2,475,961 and U.S. Pat. No. 7,392,888.

Prior-art containers generally suffer from one or two main failings. First, a container may not provide adequate protection for the items if constructed of light-weight or flexible materials, such as cardboard, plastic, or fabric. And if the container is constructed of heavier materials, such as wood or metal, to provide more robust protection for items disposed within it, the container may become so heavy as to be unsuitable for convenient storage or transport. Second, a fully or partially unused container may occupy valuable storage or transport space without serving any useful purpose. And if the container is constructed to be reconfigurable to occupy less volume when not in use, for example through folding, dismantling, or collapsing, it may require materials or a design that results in inadequate protection for the items. Or the reconfigurable container may require a design that is unsuitable for convenient storage or transport because of the complexity of the reconfiguration. And a reconfigurable container, even if it occupies less space when reconfigured, may be of no use as a container when reconfigured, such that the space that is occupied by the reconfigured container is still wholly wasted space.

U.S. Pat. No. 5,333,731 ("McCuaig") discloses a hard-sided container. Such a container serves the purpose of protecting the items disposed within the container, golf clubs in this example. But this style of container suffers a number of failings. For instance, containers of this type are heavier than is convenient. And because the container does not collapse, it requires excess space for storage when not in use and does not efficiently use space when not filled to capacity.

U.S. Patent Application Publication No. 2004/0026281 ("Boardman") discloses a hard-sided container that can be disassembled into three stackable sections when the container is not in use. But although the container occupies less space in the disassembled/stacked configuration than it does in assembled configuration, it is useless as a container when disassembled. As such, the space occupied by the disassembled/stacked Boardman container is wholly wasted. And the space occupied by the assembled/stacked container is the same regardless of whether the container is filled to capacity.

U.S. Pat. No. 7,219,902 ("Herold") discloses a container having a soft-sided enclosure mounted to a rigid base where the enclosure may be collapsed into the rigid base when the container is not in use. But although the container may be lighter than a comparable hard-sided container, the protection that the soft-sided enclosure provides to the items disposed within the container is less than a comparable hard-sided container—the container may be insufficient to adequately protect the items. And while the container occupies less space when the soft-sided enclosure is pushed down into the base, it is useless as a container when so configured. As such, the space occupied by the collapsed Herold container is wholly wasted. Further, the space occupied by the extended container is the roughly the same regardless of whether the container is filled to capacity.

U.S. Patent Application Publication No. 2006/0185999 ("Keays") discloses a container comprising a flexible cover disposed over and attached to a collapsible skeleton. The Keays skeleton is comprised of a series of sets of "ribs" and "pivot arms." Each set of ribs and pivot arms define a circumference, and the rib/pivot-arm sets are connected to each other through longitudinally extending tubes. The tubes may be telescoping or offset, such that the tubes may be fully extended to define a long, full-capacity container, or fully collapsed to reduce the space of the container when the container is not in use. And each rib is pivotally connected to a pair of pivot arms such that the pivot arms can pivot to open the skeleton, and thereby define the opening into the container. But the Keays container suffers a number of defects. For example, the longitudinal support of the fully extended skeleton is provided by only a subset of the tubes, resulting in a container that is longitudinally weaker than it would be otherwise and prone to asymmetric collapsing. And because the container is accessed by pivoting open the skeleton, the container as configured for access (i.e., open) occupies a different space than the container as configured to hold items (i.e., closed). This means that the container may have to be repositioned to allow access. And the Keays container lacks utility when collapsed, meaning that the space occupied by the collapsed container is wholly wasted. Further, the space occupied by the extended container is the same regardless of whether the container is filled to capacity.

Other collapsible containers suffer similar deficiencies. For example, U.S. Pat. No. 4,036,361 ("Jacobson") discloses a container comprising a flexible cover disposed within and attached to a collapsible frame. But the Jacobson frame components that control the collapse of the container (the "legs") operate independently, making the container cumbersome in practice. And U.S. Pat. No. 7,708,160 ("Booth") discloses a container comprising rigid side members, some of which may be folded to change the volume of the container. But the Booth frame components that control the collapse of the container (the "side members") operate independently and collapse to restrict access to the container, making the container cumbersome in practice.

Accordingly, there is a need for a light-weight configurable container-support frame that can be integrated with a surface (e.g., fabric) to create a configurable container that can be easily resized to contain different volumes and still provide adequate protection for the articles disposed within the container. There is also a need for a light-weight configurable container-support frame that can be easily configured to be disposed within pre-existing containers of different sizes and thereby improve the protection afforded by such containers to the items disposed within.

SUMMARY

The present invention is directed to systems and methods that satisfy the need for a light-weight and collapsible protective container-support frame.

In one aspect of the invention, the configurable container support frame has two or more sections, each section comprising three or more telescoping members oriented substantially parallel to each other. Each telescoping member of a section is connected to two other telescoping members through a cross member oriented substantially perpendicular to the telescoping members. The telescoping members of a section nest with the telescoping members of at least one other section by the telescoping members telescopically engaging the other telescoping members. A detent comprising a spring and a pin is disposed within each nested pair of telescoping members and selectively locks the relative positions of the nested telescoping members. A detent-release assembly comprising a system of rigid or flexible force-transfer elements is positioned within the telescoping members and cross members such that force applied to a trigger positioned in one of the frame sections is transferred through the force-transfer elements to each of the detents of a pair of nested sections to compress the detent springs and withdraw the detent pins from a holes or indentions in the walls of one of the nested telescoping members of each of the pairs of nested telescoping members. When force is applied to the trigger of the detent-release assembly, all the pairs of nested telescoping members of a nested pair of frame sections are released at substantially the same moment (i.e., "simultaneously"), and the frame sections are free to move relative to each other, thereby enabling the frame to be configured for different volume containers.

Through practice of various aspects of the invention, a container-support frame that can be used to improve the protective capabilities of existing containers or to create a configurable container with improved protective and efficiency characteristics can be constructed and used.

BRIEF DESCRIPTION OF THE SEVERAL VIEWS OF THE DRAWINGS

These and other features, aspects, and advantages of the present invention will be become better understood with reference to the following description, appended claims, and accompanying drawings where:

FIG. 11*a* is a perspective view illustrating an exemplary embodiment of a configurable container-support frame in an extended position and with detents used to selectively lock the telescoping members at different positions.

FIGS. 11*b* and 11*c* are elevation views illustrating an exemplary embodiment of nested telescoping members in an extended position and with detents used to selectively lock the telescoping members at different positions.

FIG. 14*a* is an elevation view illustrating an exemplary embodiment of a detent assembly in the released position disposed within a configurable container-support frame in an extended position.

FIG. 14*b* is an elevation view of an exemplary embodiment of a detent assembly in the released position disposed within a configurable container-support frame in an extended position, illustrating nested telescoping members released for reconfiguration.

FIG. 14*c* is a section view illustrating an exemplary embodiment of nested telescoping members in an extended position with a detent in the released position.

DESCRIPTION

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts.

Except as explicitly defined otherwise, the words and phrases used herein, including terms used in the claims, carry the same meaning they carry to one of ordinary skill in the art as ordinarily used in the art.

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Except as otherwise stated herein or as is otherwise clear from context the term "or" is used herein in its inclusive sense. For example, "A or B" means "A or B, or both A and B."

Figure 1:
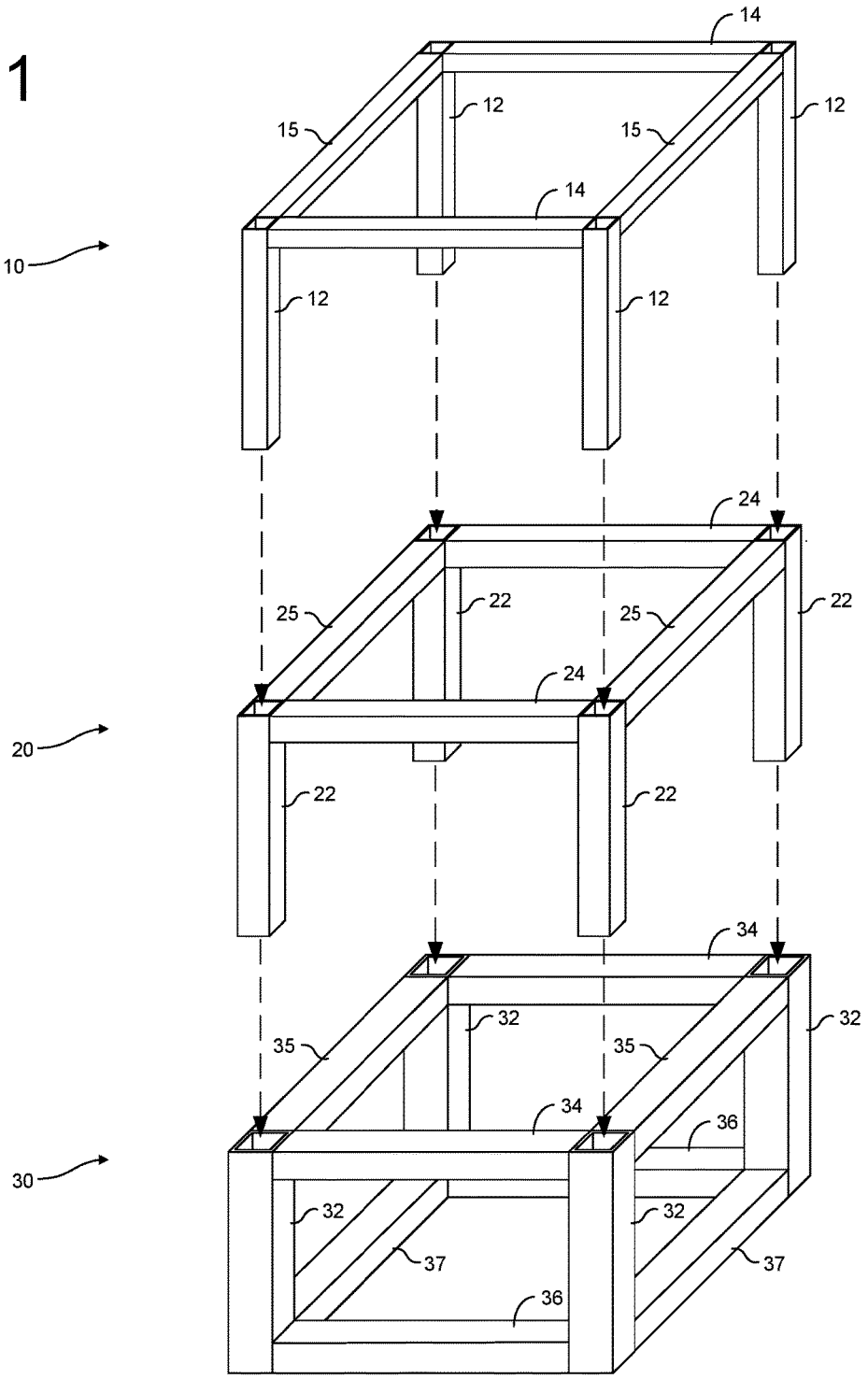
FIG. 1 is a perspective exploded view illustrating an exemplary embodiment of a configurable container-support frame, illustrating frame sections.
Figure 2A:
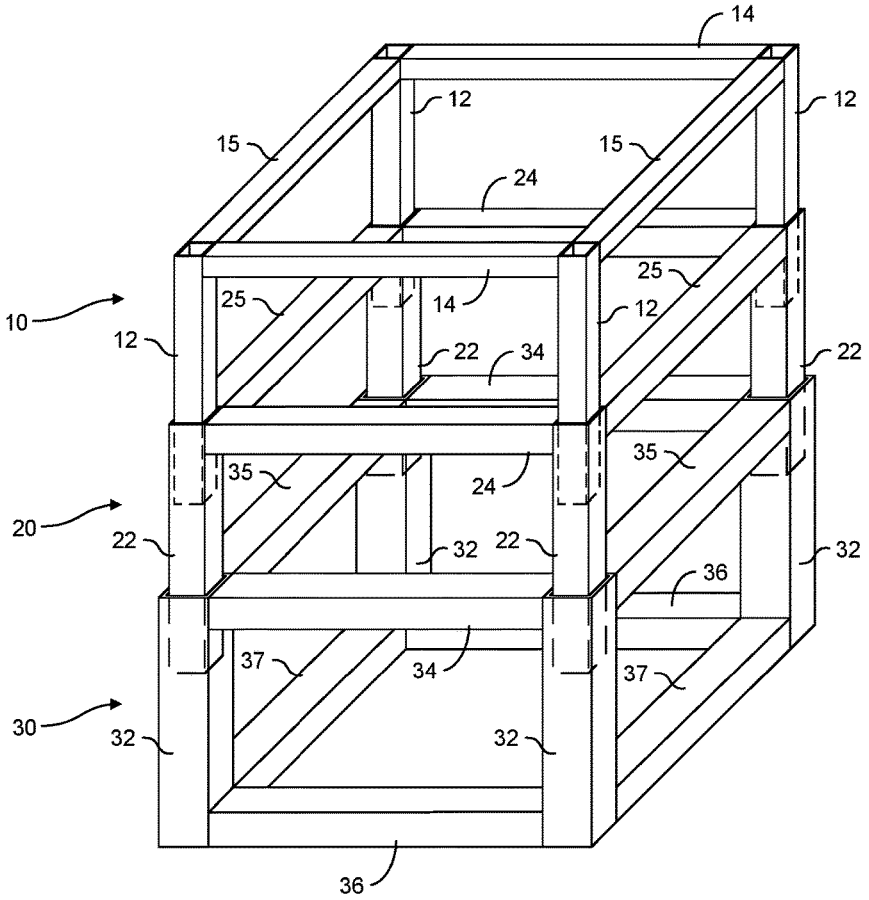
FIG. 2*a* is a perspective view illustrating an exemplary embodiment of a configurable container-support frame in an extended position.
Figure 2B:
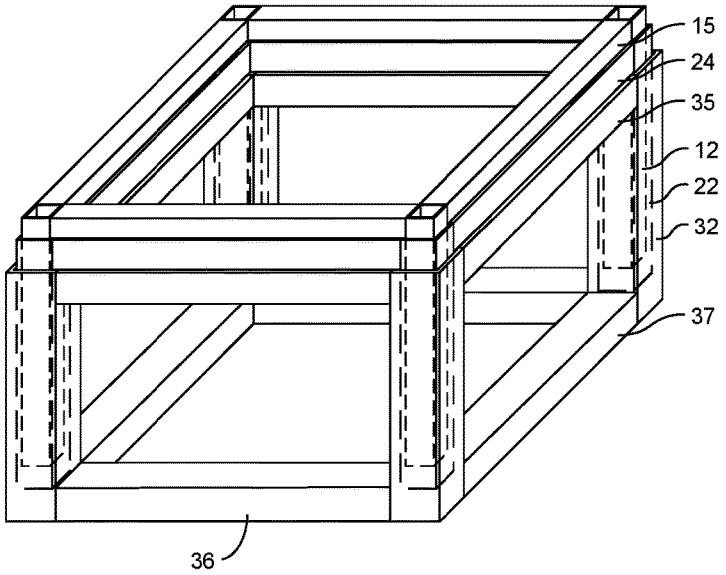
FIG. 2*b* is a perspective view illustrating an exemplary embodiment of a configurable container-support frame as fully collapsed.

An exemplary configurable container-support frame is shown in FIGS. 1, 2*a*, and 2*b*. In FIG. 1, the three sections 10, 20, 30 of the exemplary frame are shown separated in an exploded view. Each section 10, 20, 30 includes four telescoping members 12, 22, 32 oriented substantially parallel to each other. Each section 10, 20, 30 further includes four cross members 14, 15, 24, 25, 34, 35. One section 30 of the exemplary frame serves as a base section and further includes an additional four cross members 36, 37.

Each cross member 14, 15, 24, 25, 34, 35 connects to a pair of telescoping members 12, 22, 32 substantially perpendicular to each telescoping member to which it is connected. In a first section 10, each telescoping member 12 is connected to two other telescoping members 12—to the first other telescoping member 12 through a first cross member 14 and to the second other telescoping member 12 through a second cross member 15. In a second section 20, each telescoping member 22 is connected to two other telescoping members 22—to the first other telescoping member 22 through a first cross member 24 and to the second other telescoping member 22 through a second cross member 25. In a third section 30, each telescoping member 32 is connected to two other telescoping members 32—to the first other telescoping member 32 through a first cross member 34 and to the second other telescoping member 32 through a second cross member 35. The third section 30 of the exemplary frame serves as a base section and each telescoping member 32 is further connected to the two other telescoping members 32 through third and fourth cross members 36, 37—to the first other telescoping member 32 through a third cross member 36 and to the second other telescoping member 32 through a fourth cross member 37.

The telescoping members 12, 22, 32 are "telescoping" in that the telescoping members of one section fit in or over ("nest with") the telescoping members of another section such that the nested telescoping members can move relative to each other with one telescoping member sliding within the other telescoping member. The telescoping members 12, 22, 32 are oriented "substantially parallel" to each other in that when the telescoping members of one section are nested with the telescoping members of another section, the sections can move relative to each other with the telescoping members of one section sliding within the telescoping members of the other section. As indicated by the dashed arrows, the telescoping members 12 of a first section 10 fit and slide within the telescoping members 22 of a second section 20, and the telescoping members 22 of the second section 20 fit and slide within the telescoping members 32 of a third section 30. The cross members are "substantially perpendicular" to the telescoping members to which they are attached in that they are attached to allow the nested sections to move relative to each other with the telescoping members of one section sliding within the telescoping members of the other section.

The telescoping members 12, 22, 32 are shown as square cylinders but may take any shape subject to the constraints that the first section's telescoping members 12 fit and slide within the second section's telescoping members 22, and that the second section's telescoping members 22 slide within the third section's telescoping members 32.

In FIG. 2*a*, the exemplary container support frame of FIG. 1 is shown assembled and configured in an extended position. In FIG. 2*b*, the exemplary frame is shown assembled and configured in a fully collapsed position. The frame sections may be positioned relative to each other by sliding the telescoping members of one section further into or out of the telescoping members that they are nested with. Portions of the first section's telescoping members 12 that are within the second section's telescoping members 22 are shown in short-dashed lines. Portions of the second section's telescoping members 22 that are within the third section's telescoping members 32 are shown in long-dashed lines.

The exemplary frame's telescoping members 12, 22, 32 and cross members 14, 15, 24, 25, 34, 35, 36, 37 define a volume that depends on the configuration of the telescoping members. As such, the frame can be configured to be disposed within a container (e.g., a box or a bag) and thereby strengthen the container. And the frame can be integrated with a surface (e.g., a fabric covering) to create a variable-volume container that affords more protection to items disposed within than does the surface alone.

Figure 3:
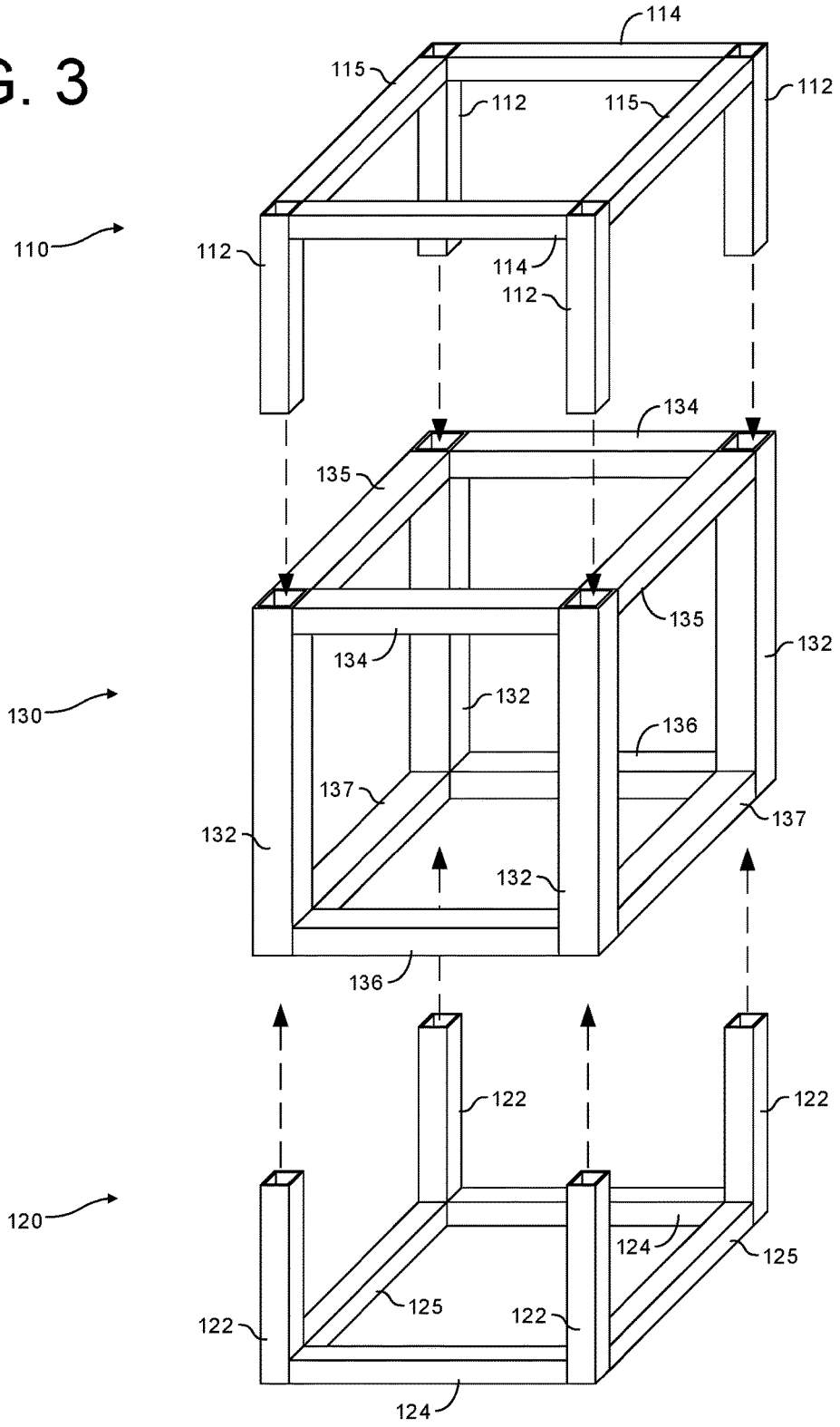
FIG. 3 is a perspective exploded view illustrating an exemplary embodiment of a configurable container-support frame, illustrating frame sections.
Figure 4A:
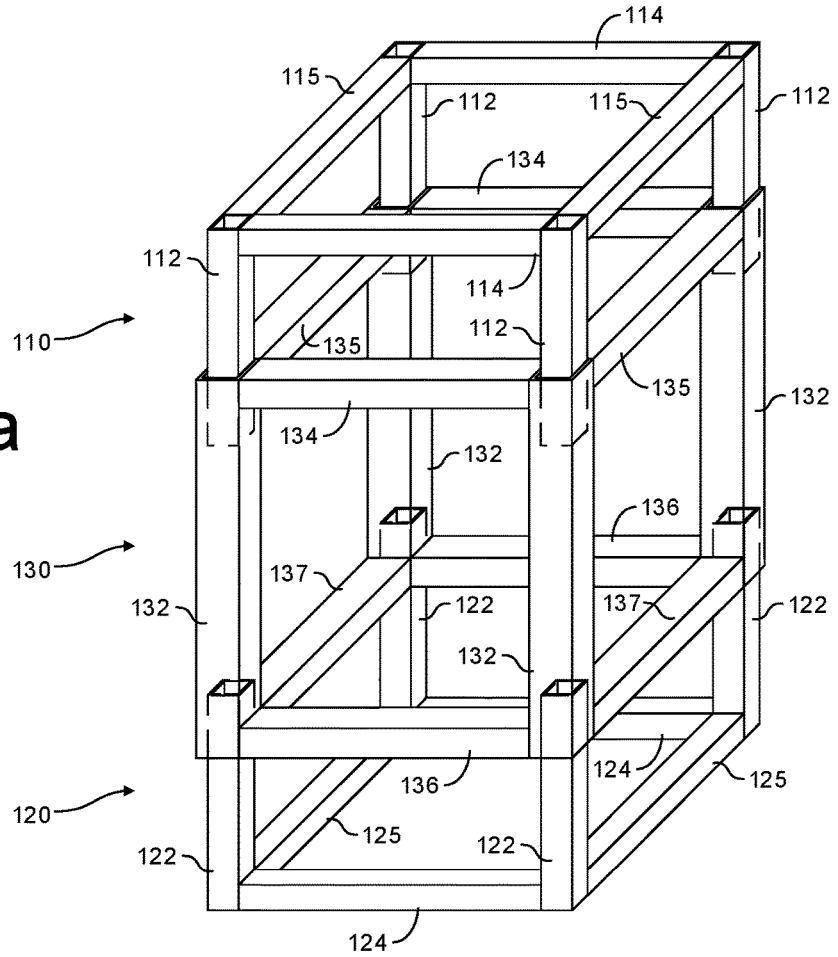
FIG. 4*a* is a perspective view illustrating an exemplary embodiment of a configurable container-support frame in an extended position.
Figure 4B:
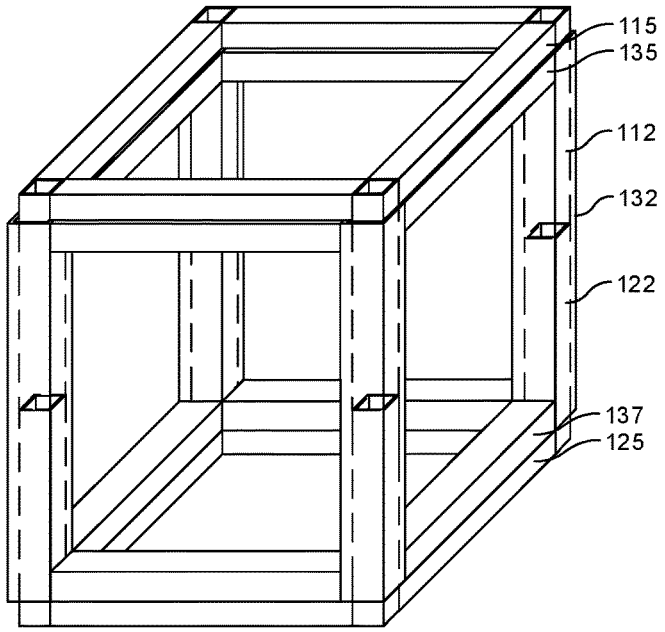
FIG. 4*b* is a perspective view illustrating an exemplary embodiment of a configurable container-support frame as fully collapsed.

Another exemplary configurable container-support frame is shown in FIGS. 3, 4*a*, and 4*b*. In FIG. 3, the three sections 110, 120, 130 of the exemplary frame are shown separated in an exploded view. Each section 110, 120, 130 includes four telescoping members 112, 122, 132 oriented substantially parallel to each other. Each section 110, 120, 130 further includes four cross members 114, 115, 124, 125, 134, 135. One section 130 of the exemplary frame serves as a base section and further includes an additional four cross members 136, 137.

Each cross member 114, 115, 124, 125, 134, 135 connects to a pair of telescoping members 112, 122, 132 substantially perpendicular to each telescoping member to which it is connected. In a first section 110, each telescoping member 112 is connected to two other telescoping members 112—to the first other telescoping member 112 through a first cross member 114 and to the second other telescoping member 112 through a second cross member 115. In a second section 120, each telescoping member 122 is connected to two other telescoping members 122—to the first other telescoping member 122 through a first cross member 124 and to the second other telescoping member 122 through a second cross member 125. In a third section 130, each telescoping member 132 is connected to two other telescoping members 132—to the first other telescoping member 132 through a first cross member 134 and to the second other telescoping member 132 through a second cross member 135. The third section 130 of the exemplary frame serves as a base section and each telescoping member 132 is further connected to the two other telescoping members 132 through third and fourth cross members 136, 137—to the first other telescoping member 132 through a third cross member 136 and to the second other telescoping member 132 through a fourth cross member 137.

The telescoping members 112, 122, 132 are "telescoping" in that the telescoping members of one section fit in or over ("nest with") the telescoping members of another section such that the nested telescoping members can move relative to each other with one telescoping member sliding within the other telescoping member. The telescoping members 112, 122, 132 are oriented "substantially parallel" to each other in that when the telescoping members of one section are nested with the telescoping members of another section, the sections can move relative to each other with the telescoping members of one section sliding within the telescoping members of the other section. As indicated by the dashed arrows, the telescoping members 112 of a first section 110 and the telescoping members 122 of a second section 120 fit within the telescoping members 132 of a third section 130. The cross members are "substantially perpendicular" to the telescoping members to which they are attached in that they are attached to allow the nested sections to move relative to each other with the telescoping members of one section sliding within the telescoping members of the other section.

The telescoping members 112, 122, 132 are shown as square cylinders but may take any shape subject to the constraints that the first section's telescoping members 112 and the second section's telescoping members 122 fit and slide within the third section's telescoping members 132.

In FIG. 4*a*, the exemplary container support frame of FIG. 3 is shown assembled and configured in an extended position. In FIG. 4*b*, the exemplary frame is shown assembled and configured in a fully collapsed position. The frame sections may be positioned relative to each other by sliding the telescoping members of one section further into or out of the telescoping members that they are nested with. Portions of the first section's telescoping members 112 and the second section's telescoping members 122 that are within the third section's telescoping members 132 are shown in short-dashed lines.

The exemplary frame's telescoping members 112, 122, 132 and cross members 114, 115, 124, 125, 134, 135, 136, 137 define a volume that depends on the configuration of the telescoping members. As such, the frame can be configured to be disposed within a container (e.g., a box or bag) and thereby strengthen the container. And the frame can be integrated with a surface (e.g., a fabric covering) to create a variable-volume container that affords more protection to items disposed within than does the surface alone.

Figure 5:
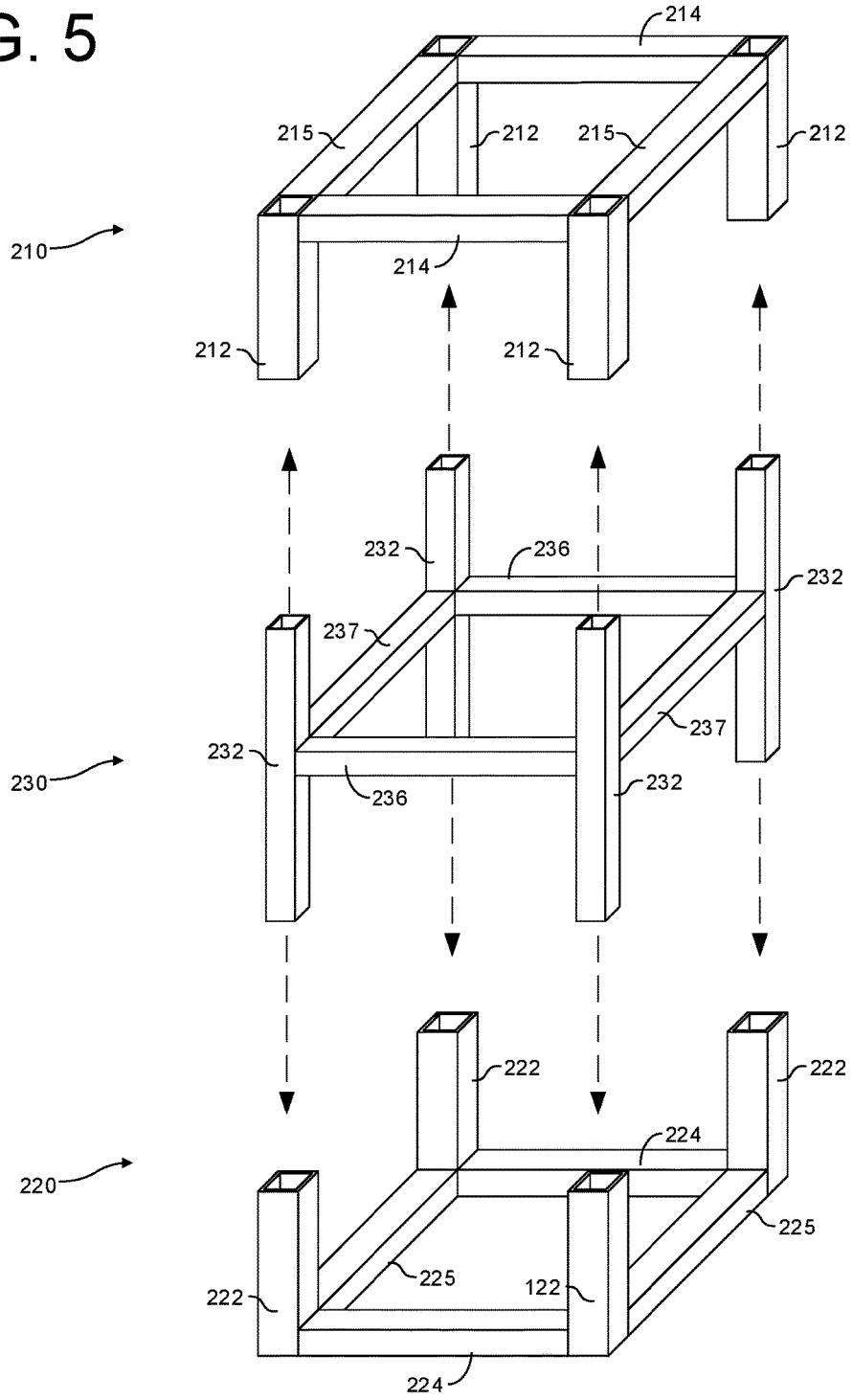
FIG. 5 is a perspective exploded view illustrating an exemplary embodiment of a configurable container-support frame, illustrating frame sections.
Figure 6A:
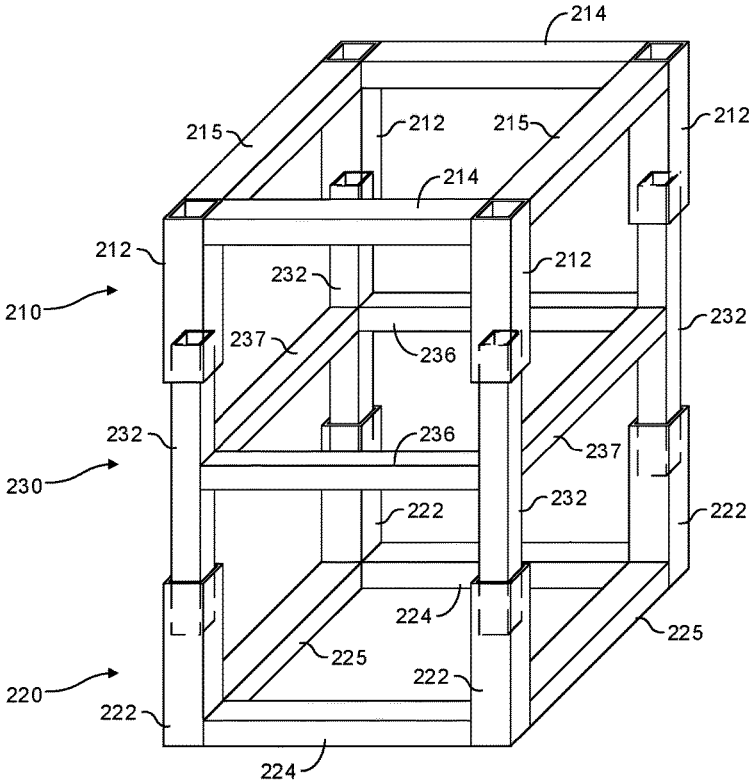
FIG. 6*a* is a perspective view illustrating an exemplary embodiment of a configurable container-support frame in an extended position.
Figure 6B:
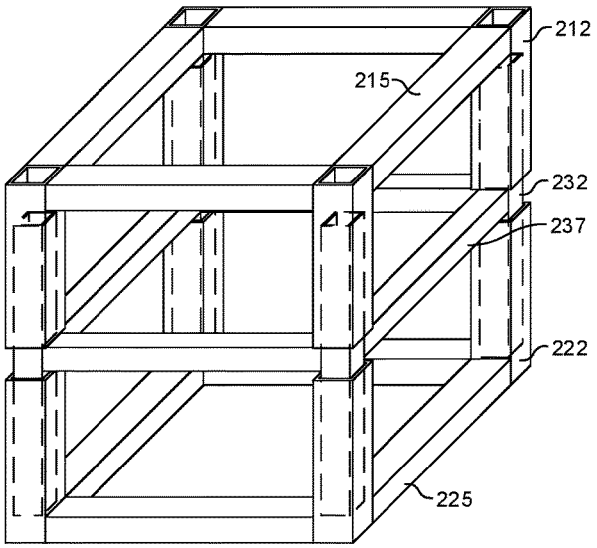
FIG. 6*b* is a perspective view illustrating an exemplary embodiment of a configurable container-support frame as fully collapsed.

Another exemplary configurable container-support frame is shown in FIGS. 5, 6*a*, and 6*b*. In FIG. 5, the three sections 210, 220, 230 of the exemplary frame are shown separated in an exploded view. Each section 210, 220, 230 includes four telescoping members 212, 222, 232 oriented substantially parallel to each other. Each section 210, 220, 230 further includes four cross members 214, 215, 224, 225, 234, 235.

Each cross member 214, 215, 224, 225, 234, 235 connects to a pair of telescoping members 212, 222, 232 substantially perpendicular to each telescoping member to which it is connected. In a first section 210, each telescoping member 212 is connected to two other telescoping members 212—to the first other telescoping member 212 through a first cross member 214 and to the second other telescoping member 212 through a second cross member 215. In a second section 220, each telescoping member 222 is connected to two other telescoping members 222—to the first other telescoping member 222 through a first cross member 224 and to the second other telescoping member 222 through a second cross member 225. In a third section 230, each telescoping member 232 is connected to two other telescoping members 232—to the first other telescoping member 232 through a first cross member 236 and to the second other telescoping member 232 through a second cross member 237.

The telescoping members 212, 222, 232 are "telescoping" in that the telescoping members of one section fit in or over ("nest with") the telescoping members of another section such that the nested telescoping members can move relative to each other with one telescoping member sliding within the other telescoping member. The telescoping members 212, 222, 232 are oriented "substantially parallel" to each other in that when the telescoping members of one section are nested with the telescoping members of another section, the sections can move relative to each other with the telescoping members of one section sliding within the telescoping members of the other section. As indicated by the dashed arrows, the telescoping members 212 of a first section 210 and the telescoping members 222 of a second section 220 fit over the telescoping members 232 of a third section 230. The cross members are "substantially perpendicular" to the telescoping members to which they are attached in that they are attached to allow the nested sections to move relative to each other with the telescoping members of one section sliding within the telescoping members of the other section.

The telescoping members 212, 222, 232 are shown as square cylinders but may take any shape subject to the constraints that the first section's telescoping members 212 and the second section's telescoping members 222 fit and slide over the third section's telescoping members 232.

In FIG. 6*a*, the exemplary container support frame of FIG. 5 is shown assembled and configured in an extended position. In FIG. 6*b*, the exemplary frame is shown assembled and configured in a fully collapsed position. The frame sections may be positioned relative to each other by sliding the telescoping members of one section further into or out of the telescoping members that they are nested with. Portions of the third section's telescoping members 232 that are within the first section's telescoping members 112 or the second section's telescoping members 122 are shown in short-dashed lines.

The exemplary frame's telescoping members 212, 222, 232 and cross members 214, 215, 224, 225, 236, 237 define a volume that depends on the configuration of the telescoping members. As such, the frame can be configured to be disposed within a container (e.g., a box or bag) and thereby strengthen the container. And the frame can be integrated with a surface (e.g., a fabric covering) to create a variable-volume container that affords more protection to items disposed within than does the surface alone.

Figure 7:
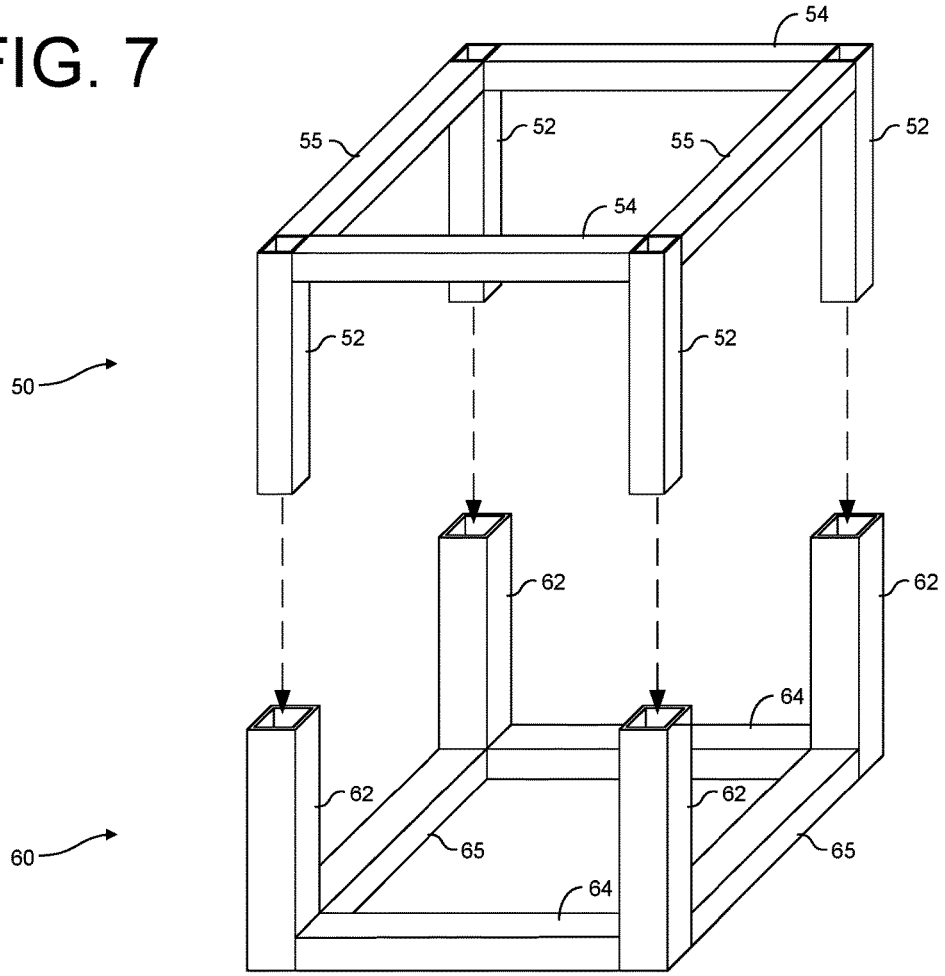
FIG. 7 is a perspective exploded view illustrating an exemplary embodiment of a configurable container-support frame, illustrating frame sections.
Figure 8A:
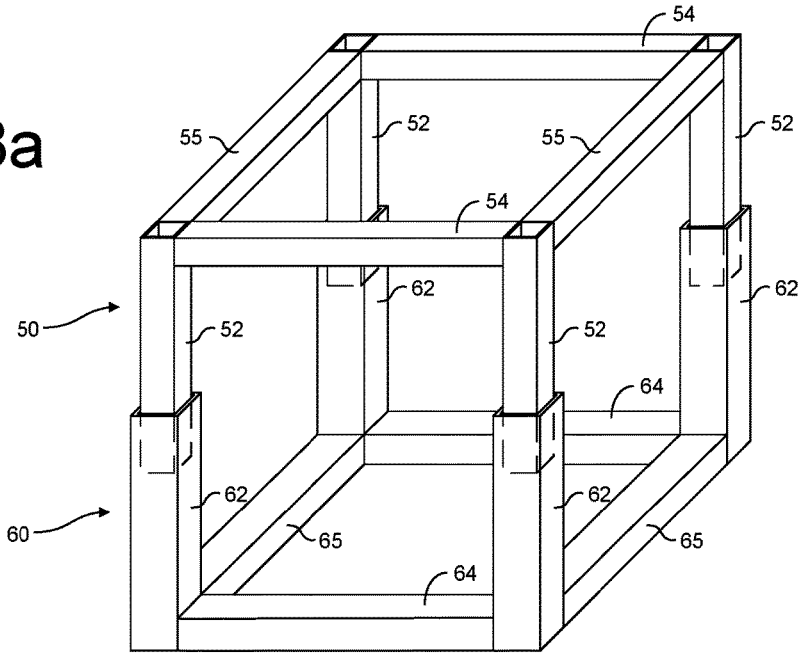
FIG. 8*a* is a perspective view illustrating an exemplary embodiment of a configurable container-support frame in an extended position.
Figure 8B:
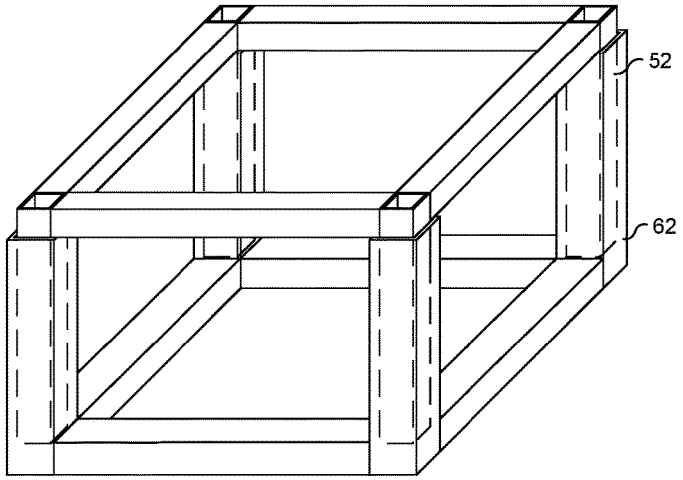
FIG. 8*b* is a perspective view illustrating an exemplary embodiment of a configurable container-support frame as fully collapsed.

Another exemplary configurable container-support frame is shown in FIGS. 7, 8*a*, and 8*b*. In FIG. 7, the two sections 50, 60 of the exemplary frame are shown separated in an exploded view. Each section 50, 60 includes four telescoping members 52, 62 oriented substantially parallel to each other. Each section 50, 60 further includes four cross members 54, 55, 64, 65.

Each cross member 54, 55, 64, 65 connects to a pair of telescoping members 12, 22 substantially perpendicular to each telescoping member to which it is connected. In a first section 50, each telescoping member 52 is connected to two other telescoping members 52—to the first other telescoping member 52 through a first cross member 54 and to the second other telescoping member 12 through a second cross member 55. In a second section 60, each telescoping member 62 is connected to two other telescoping members 62—to the first other telescoping member 62 through a first cross member 64 and to the second other telescoping member 62 through a second cross member 65.

The telescoping members 52, 62 are "telescoping" in that the telescoping members of one section fit in or over ("nest with") the telescoping members of another section such that the nested telescoping members can move relative to each other with one telescoping member sliding within the other telescoping member. The telescoping members 52, 62 are oriented "substantially parallel" to each other in that when the telescoping members of one section are nested with the telescoping members of another section, the sections can move relative to each other with the telescoping members of one section sliding within the telescoping members of the other section. As indicated by the dashed arrows, the telescoping members 52 of a first section 50 fit and slide within the telescoping members 62 of a second section 60. The cross members are "substantially perpendicular" to the telescoping members to which they are attached in that they are attached to allow the nested sections to move relative to each other with the telescoping members of one section sliding within the telescoping members of the other section.

The telescoping members 52, 62 are shown as square cylinders but may take any shape subject to the constraints that the first section's telescoping members 52 fit and slide within the second section's telescoping members 62.

In FIG. 8*a*, the exemplary container support frame of FIG. 7 is shown assembled and configured in an extended position. In FIG. 8*b*, the exemplary frame is shown assembled and configured in a fully collapsed position. The frame sections may be positioned relative to each other by sliding the telescoping members of one section further into or out of the telescoping members that they are nested with. Portions of the first section's telescoping members 52 that are within the second section's telescoping members 62 are shown in long-dashed lines.

The exemplary frame's telescoping members 52, 62 and cross members 54, 55, 64, 65 define a volume that depends on the configuration of the telescoping members. As such, the frame can be configured to be disposed within a container (e.g., a box or a bag) and thereby strengthen the container. And the frame can be integrated with a surface (e.g., a fabric covering) to create a variable-volume container that affords more protection to items disposed within than does the surface alone.

Figure 9:
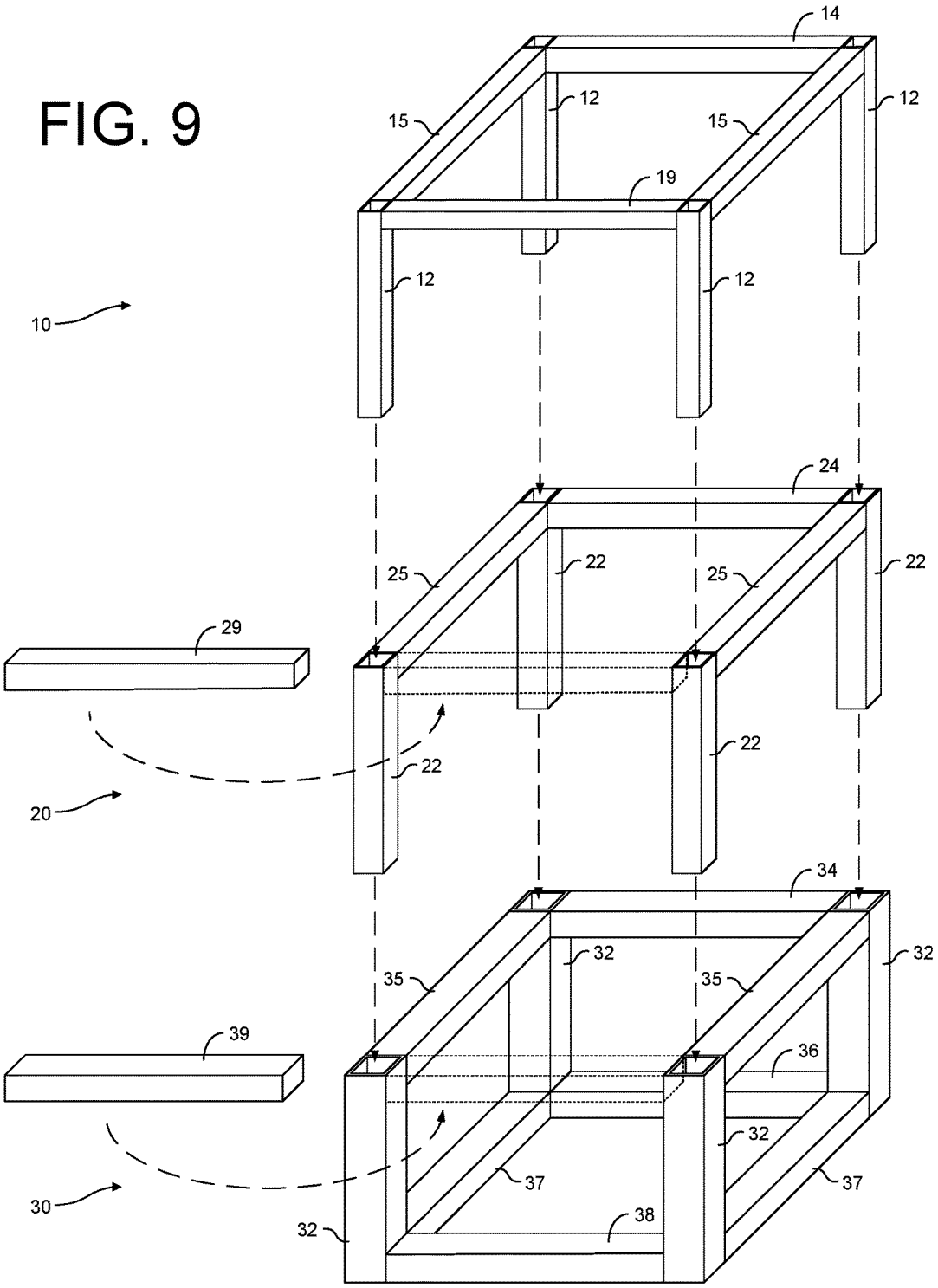
FIG. 9 is a perspective exploded view illustrating an exemplary embodiment of a configurable container-support frame, illustrating frame sections.
Figure 10:
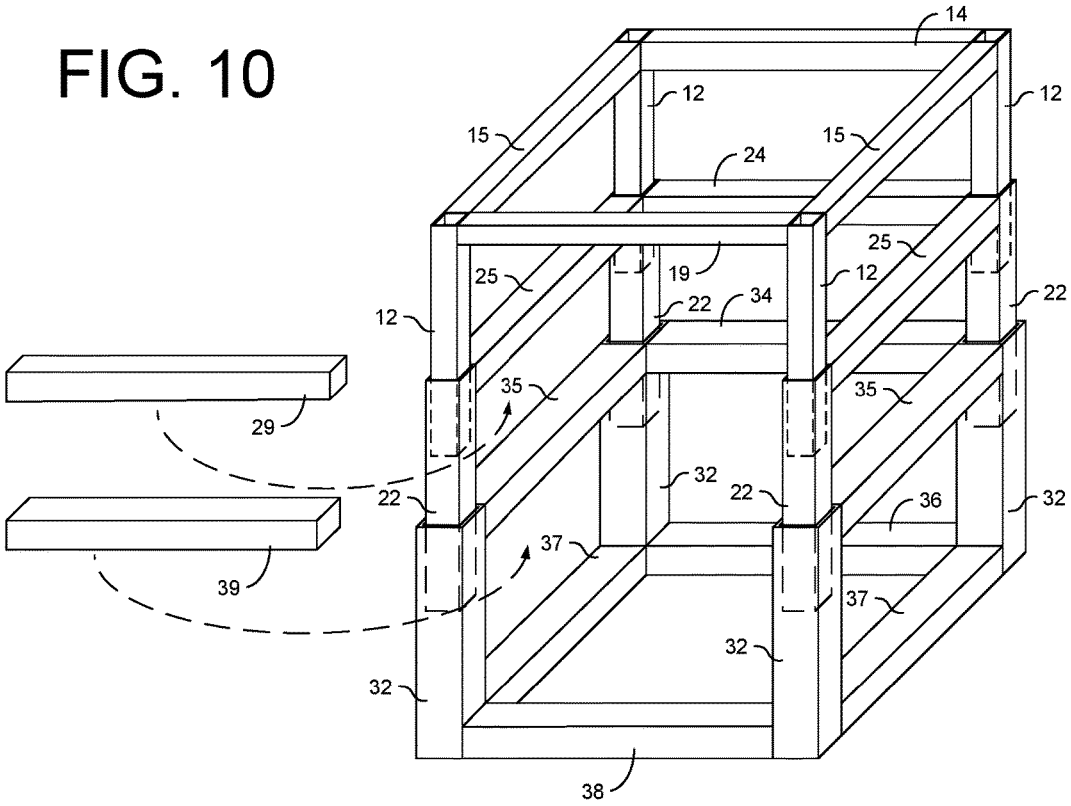
FIG. 10 is a perspective view illustrating an exemplary embodiment of a configurable container-support frame in an extended position.

Another exemplary configurable container-support frame is shown in FIGS. 9 and 10. In FIG. 9, the three sections 10, 20, 30 of the exemplary frame are shown separated in an exploded view. In FIG. 10, the exemplary container support frame of FIG. 9 is shown assembled and configured in an extended position. In this embodiment, the frame of FIG. 1 has been modified by replacing one or more cross members of the frame sections 10, 20, and 30 with a cross member that can be moved to enlarge the opening by which the interior volume defined by the frame may be accessed. These three sections are as described with reference to FIG. 1, with the exceptions that: (1) one of the first section's cross members 14 is replaced with a removable cross member 19, (2) the second section's cross member 24 on the same side of the frame as the first section's removable cross member 19 is replaced with a removable cross member 29, (3) one of the third section's cross members 34 on the same side of the frame as the first section's removable cross member 19 is replaced with a removable cross member 39, and (4) another of the third section's cross members 36 on the same side of the frame as the first section's removable cross member 19 is replaced with a removable cross member 38.

The removable cross members are "removable" in that they can be moved away from the side of the frame to enlarge the opening on that side of the frame. In FIG. 10, the first section's removable cross member 19 is shown in place in the first section 10. The second section's removable cross member 29 is shown as removed from the second section 20. The third section's first removable cross member 39 is shown as removed from the third section 30. The third section's second removable cross member 38 is shown in place in the third section 30. The removed removable cross members are shown as fully detached from the sections, but they need not be so detached. For example, a removable cross member can be attached to a telescoping member with a hinge, such that the cross member can pivot away from the frame to enlarge the opening in one side of the frame.

Another exemplary configurable container-support frame is shown in FIGS. 11*a*, 11*b*, 11*c*. In this embodiment, the frame of FIGS. 1, 2*a*, and 2*b* further includes spring-actuated detents to lock the telescoping members 12, 22, 32 in position relative to each other. FIG. 11*a* depicts the exemplary container support frame as assembled and configured in an extended position. The first section's telescoping members 22 and the second section's telescoping members 32 include hole patterns 21, 31 to allow locking of the telescoping members at different positions. FIG. 11*b* depicts one set of nested telescoping members 12, 22, 32 of the exemplary frame, viewed facing the surfaces with the hole patterns 21, 31. FIG. 11*c* depicts one set of nested telescoping members 12, 22, 32 of the exemplary frame, viewed facing the surfaces adjacent to the surfaces with the hole patterns; the surfaces with the hole patterns 21, 31 are facing to the right.

As shown in FIG. 11*c*, a detent spring 17 and pin 19 are positioned within the first section's telescoping member 12. This detent is shown in the released position in that the pin 19 is not engaged with a hole of the hole pattern 21 of the second section's telescoping member 22. Thus, the first section's telescoping member 12 is free slide within the second section's telescoping member 22.

As shown in FIG. 11*c*, another detent spring 27 and pin 29 are positioned within the second section's telescoping member 22. This detent is shown in the locked position in that the pin 29 is engaged with a hole of the hole pattern 31 of the third section's telescoping member 32. Thus, the second section's telescoping member 22 is prevented from sliding within the third section's telescoping member 32.

Figure 12:
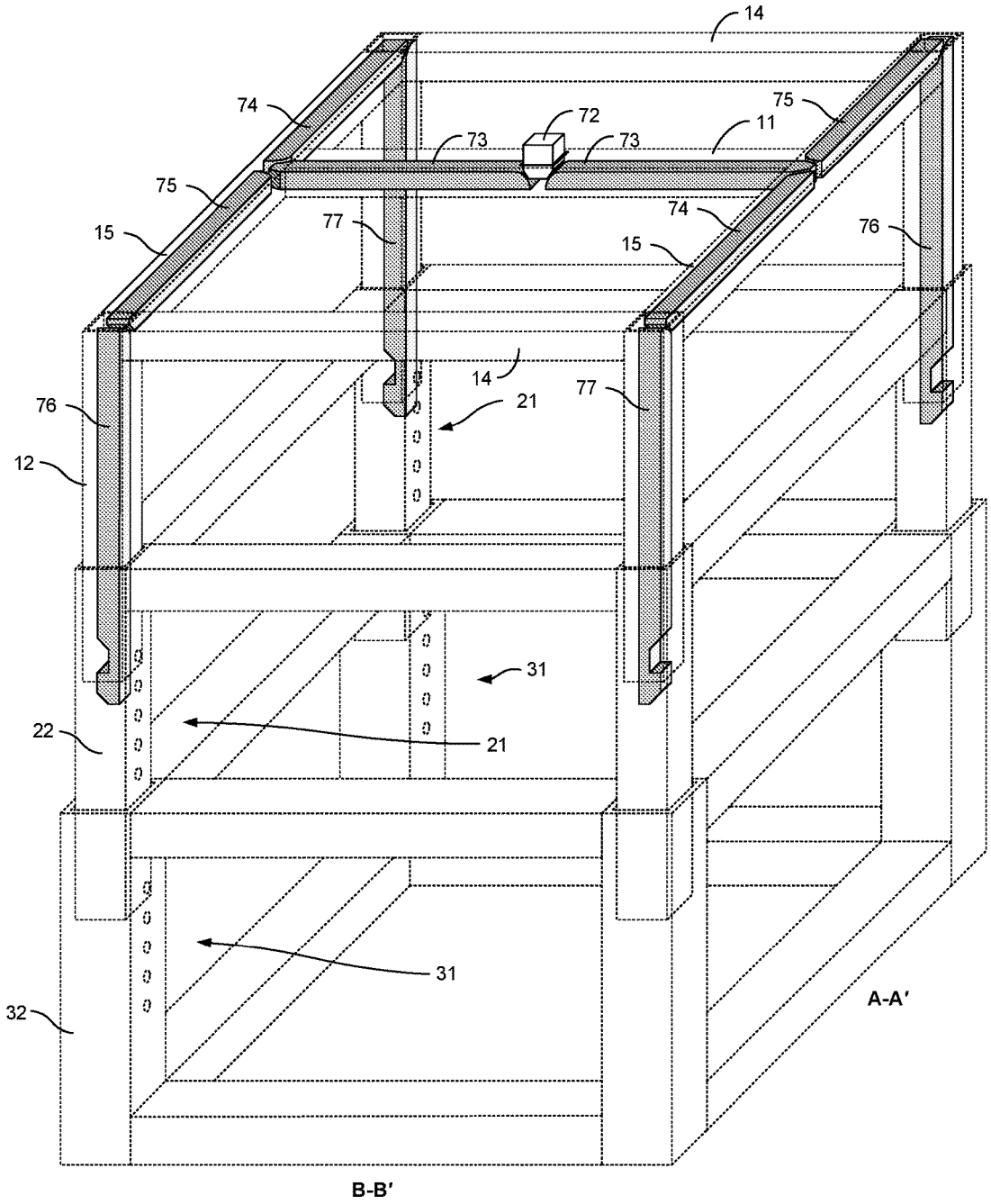
FIG. 12 is a perspective view illustrating an exemplary embodiment of a detent-control assembly disposed within a configurable container-support frame in an extended position.

An exemplary embodiment of a single-trigger multi-detent-control assembly for a configurable container-support frame is shown in FIG. 12. The detent-control assembly is illustrated as disposed within the frame of FIG. 1 in an extended position but modified to include a central cross member 11 connecting opposing cross members 15 of the frames first section. The frame is depicted as if invisible as denoted by the dotted lines. A trigger 72 is disposed in the central cross member 11. The detent-control assembly includes a system of force-transfer elements 73, 74, 75, 76, 77 that transfer the force applied to the trigger 72 to detent pins and springs disposed within the telescoping members.

The trigger 72 is shaped such that when it is pushed into the central cross member 11 it engages the ends of two force-transfer elements 73 disposed within the central cross member 11 on either side of the trigger 72. The end of each of the central cross member's force-transfer elements 73 that is nearest to the trigger 72 is shaped such that when engaged with the trigger 72, the force applied to the trigger 72 causes the central cross member's force-transfer elements 73 to move along and within the central cross member 11 away from the trigger 72.

The end of each of the central cross member's force-transfer elements 73 that is farthest from the trigger 72 is shaped such that when the force-transfer element 73 is pushed away from the trigger 72 it engages the ends of two force-transfer elements 74, 75 disposed within the opposing cross members 15 spanned by the central cross member 11. The end of each of the opposing cross members' force-transfer elements 74, 75 that is nearest to the corresponding central cross member's force-transfer element 73 is shaped such that when engaged with the central cross member's force-transfer element 73, the force applied to the central cross member's force-transfer element 73 through the trigger 72 causes the opposing cross members' force-transfer elements 74, 75 to move along and within the opposing cross members 15 away from the central cross member's force-transfer elements 73.

The end of each of the opposing cross members' force-transfer elements 74, 75 that is farthest from the central cross member's force-transfer elements 73 is shaped such that when the opposing cross members' force-transfer elements 74, 75 are pushed away from the central cross member's force-transfer elements 73, each engages the ends of a force-transfer element 76, 77 disposed within each of the first section's telescoping members 12. As each of the opposing cross members' force-transfer elements 74, 75 move along and within the opposing cross members 15 away from the central cross member's force-transfer elements 73, the opposing cross members' force-transfer elements 74, 75 force the telescoping members' force-transfer elements 76, 77 to move along and within the first section's telescoping members 12 away from opposing cross members' force-transfer elements 74, 75. As oriented in FIG. 12, force applied to the trigger 72 causes the telescoping members' force-transfer elements 76, 77 to move downward.

Figure 13A:
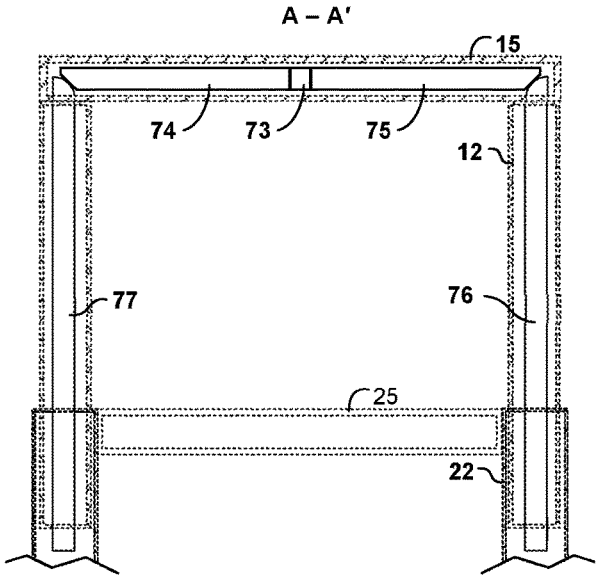
FIG. 13*a* is an elevation view illustrating an exemplary embodiment of a detent assembly in the locked position disposed within a configurable container-support frame in an extended position.
Figure 13B:
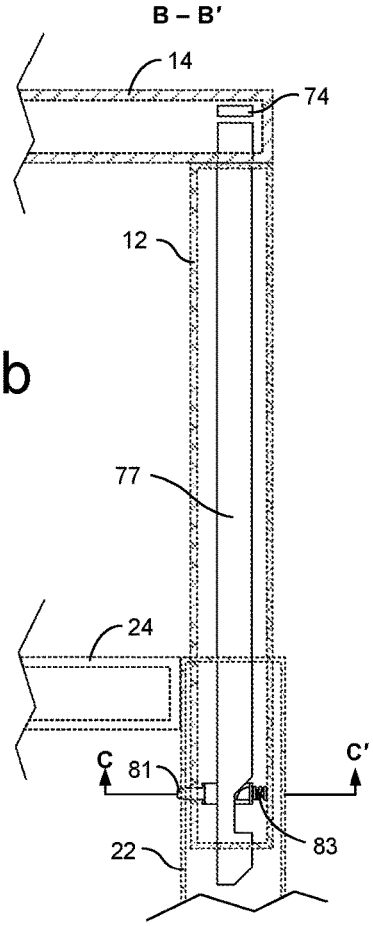
FIG. 13*b* is an elevation view of an exemplary embodiment of a detent assembly in the locked position disposed within a configurable container-support frame in an extended position, illustrating nested telescoping members locked into a position.
Figure 13C:
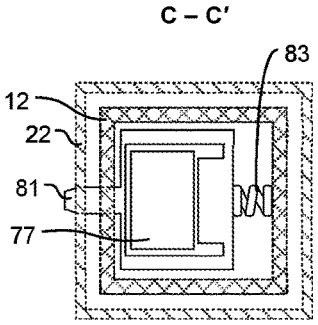
FIG. 13*c* is a section view illustrating an exemplary embodiment of nested telescoping members locked in an extended position.

The exemplary detent-control assembly shown in FIG. 12 can be further understood with reference to FIGS. 13*a*, 13*b*, 13*c*, 14*a*, 14*b*, and 14*c*. FIG. 13*a* is a view of a portion of face A-A' of FIG. 12 with detents in the locked position. This further illustrates the positioning and engagement of: (1) a central cross member's force-transfer element 73 with an opposing cross member's force-transfer elements 74, 75, and (2) an opposing cross member's force-transfer elements 74, 75 with two telescoping members' force-transfer elements 76, 77 when no force is applied to trigger 72. FIG. 13*b* is a view of a portion of face B-B' of FIG. 12 with detents in the locked position. A detent assembly comprising a detent spring 83 and a detent pin 81 is positioned within each of the first section's telescoping members 12. The spring 83 exerts a force on the pin 81 in the direction of holes in the second section's telescoping member 22 that is nested with the first section's telescoping member 12. The end of each of the telescoping members' force-transfer elements 76, 77 that is nearest to the pin 81 is shaped such that when a force is applied to trigger 72, each force-transfer element 76, 77 engages the pin 81 thereby compressing the spring 83. When the spring 83 is compressed, the pin 81 moves away from the holes in the second section's telescoping member 22. When no force is applied to the trigger 72, the telescoping member's force-transfer elements 76, 77 do not compress the springs 83. As shown in FIG. 13*b*, the telescoping members' force-transfer elements 76, 77 may be configured to engage a first detent pin 81 positioned in the first section's telescoping member 12 as well as a second detent pin positioned below the first detent pin 81 (described later with reference to FIGS. 15*a*, 15*b*, 15*c*, 16*a*, 16*b*, 16*c*). FIG. 13*c* is a view of section C-C' of FIG. 13*b* and further illustrates the positioning and engagement of the force-transfer element 77, the pin 81, and the spring 83 when no force is applied to the trigger 72. The detent pin 81 is shown in FIGS. 13*b* and 13*c* as extending through a hole in the second section's telescoping member 22 thereby locking the relative positions of the first section's telescoping member 12 and the second section's telescoping member 22.

FIG. 14*a* is a view of a portion of face A-A' of FIG. 12 with detents in the released position. This further illustrates the positioning and engagement of: (1) a central cross member's force-transfer element 73 with an opposing cross member's force-transfer elements 74, 75, and (2) an opposing cross member's force-transfer elements 74, 75 with two telescoping members' force-transfer elements 76, 77 when force is applied to trigger 72. FIG. 14*b* is a view of a portion of face B-B' of FIG. 12 with detents in the released position. When force is applied to the trigger 72, the telescoping members' force-transfer elements 76, 77 move down along the first section's telescoping members 12, engage the detent pin 81, and compress detent spring 83, thereby moving the pin 81 to withdraw it from the holes in the second section's telescoping members 22. FIG. 14*c* is a view of section D-D' of FIG. 14*b* and further illustrates the positioning and engagement of the force-transfer element 77, the pin 81, and the spring 83 when force is applied to the trigger 72. When the force is applied to the trigger 72, the first telescoping section's force-transfer element 76, 77 moves down within the first section's telescoping member 12, engages the pin 81, and compresses the spring 83, whereby the pin 81 is withdrawn from the holes in the second section's telescoping member 22. The detent pin 81 is shown in FIGS. 14*b* and 14*c* as withdrawn from the holes in the second section's telescoping member 22 thereby freeing the first section's telescoping member 12 and the second section's telescoping member 22 to slide one within the other (i.e., to telescope).

Figure 15A:
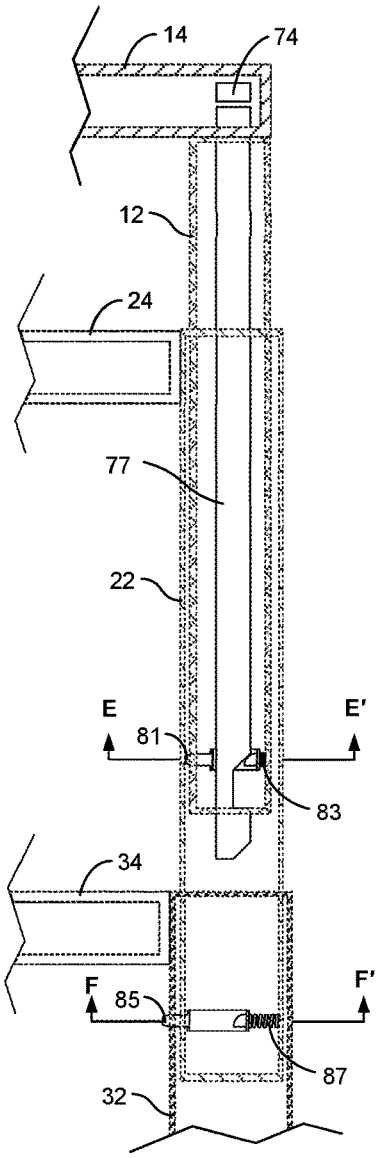
FIG. 15*a* is an elevation view illustrating an exemplary embodiment of a detent assembly disposed within a configurable container-support frame in an extended position where a detent is in the released position for a first pair of nested telescoping members and a detent is in the locked position for a second pair of nested telescoping members and where the first pair of telescoping members are partially collapsed.
Figure 15B:
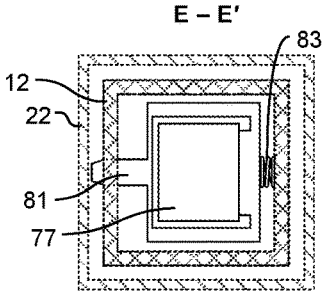
FIG. 15*b* is a section view illustrating an exemplary embodiment of nested telescoping members in an extended position with a detent in the released position for a first pair of nested telescoping members.

The exemplary detent-control assembly shown in FIG. 12 can be further understood with reference to FIGS. 15*a*, 15*b*, 15*c*, 16*a*, 16*b*, and 16*c*. These figures depict force-transfer elements 74, 77 and detent assemblies 81, 83, 85, 87 of nested telescoping members 12, 22, 32, of the three-section container-support frame of FIG. 12 with force applied to the trigger 72. As shown in FIG. 15*a*, the detent pin 81 in the first section's telescoping member 12 is withdrawn from the holes of the second section's telescoping member 22 as described above with reference to FIGS. 13*a*, 13*b*, 13*c*, 14*a*, 14*b*, and 14*c*. While pin 81 is in the released position, the first section's telescoping member 12 may be moved further into or out of the second section's telescoping member 22. By moving the first section's telescoping member 12 into or out of the second section's telescoping member 22, the pin 81 may be positioned to extend through a different hole in the second section's telescoping member 22, thereby configuring the container-support frame for a different volume container. FIG. 15*b* is a view of section E-E' of FIG. 15*a* and further illustrates the positioning and engagement of the force-transfer element 77, the pin 81, and the spring 83 when force is applied to the trigger 72.

Figure 15C:
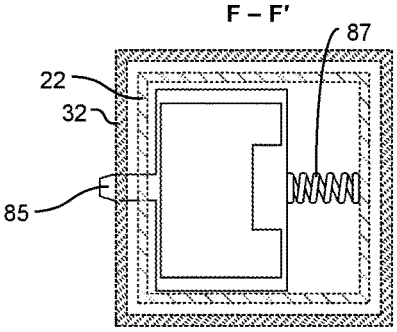
FIG. 15*c* is a section view illustrating an exemplary embodiment of nested telescoping members in an extended position with a detent in the locked position for a second pair of nested telescoping members.

As shown in FIG. 15*a*, a second detent assembly comprising a second detent spring 87 and a second detent pin 85 is positioned within each of the second sections telescoping members 22. The second spring 87 exerts a force on the second pin 85 in the direction of holes in the third section's telescoping member 32 that is nested with the second section's telescoping member 22. The end of each of the telescoping members' force-transfer elements 76, 77 that is nearest to the second pin 85 is shaped such that when a force is applied to trigger 72, each force-transfer element 76, 77 engages the second pin 85 thereby compressing the second spring 87. When the second spring 87 is compressed, the second pin 85 moves away from the holes in the third section's telescoping member 32. When no force is applied to the trigger 72, the force-transfer element 76, 77 does not compress the second spring 87. FIG. 15*c* is a view of section F-F' of FIG. 15*a* and further illustrates the positioning and engagement of the force-transfer element 77, the second pin 85, and the second spring 87 when the telescoping member's force-transfer element 77 is not positioned to engage the second pin 85. The second detent pin 85 is shown in FIGS. 15*a* and 15*c* as extending through a hole in the third section's telescoping member 32 thereby locking the relative positions of the second section's telescoping member 22 and the third section's telescoping member 32.

Figure 16A:
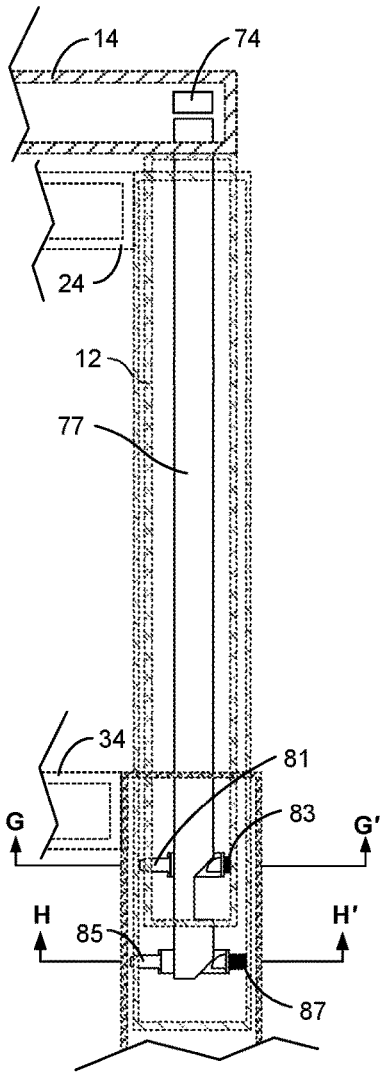
FIG. 16*a* is an elevation view illustrating an exemplary embodiment of a detent assembly disposed within a configurable container-support frame in an extended position where a detent is in the released position for a first pair of nested telescoping members and a detent is in the released position for a second pair of nested telescoping members and where the first pair of telescoping members are fully collapsed
Figure 16B:
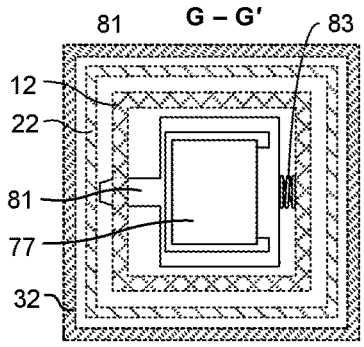
FIG. 16*b* is a section view illustrating an exemplary embodiment of nested telescoping members with a first pair of telescoping members in a fully collapsed position with a detent in the released position and a second pair of telescoping members in an extended position with a detent in the released position.
Figure 16C:
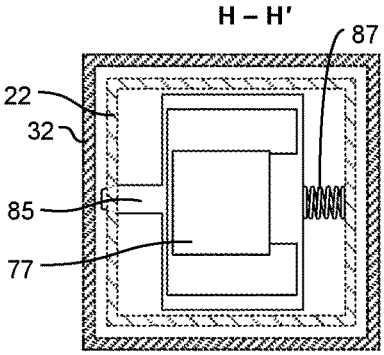
FIG. 16*c* is a section view illustrating an exemplary embodiment of nested telescoping members with a first pair of telescoping members in a fully collapsed position with a detent in the released position and a second pair of telescoping members in an extended position with a detent in the released position.

As shown in FIG. 16*a*, the first section's telescoping member 12 may be positioned within the second section's telescoping member 22 such that the telescoping member's force transfer element 76, 77 engages the second detent pin 85 that is positioned in the second section's telescoping member 22 that is nested with the first section's telescoping member 12. When force is applied to the trigger 72 when the first section's telescoping member 12 and the second section's telescoping member 22 are so positioned, the second detent spring 87 is compressed and the second detent pin 85 is withdrawn from the holes of the third section's telescoping member 32 that is nested with the second section's telescoping member 22. While pin 85 is in the released position, the second section's telescoping member 22 may be moved further into or out of the third section's telescoping member 32. By moving the second section's telescoping member 22 into or out of the third section's telescoping member 32, the pin 85 may be positioned to extend through a different hole in the third section's telescoping member 32, thereby configuring the container-support frame for a different volume container. FIG. 16*b* is a view of section G-G' of FIG. 16*a* and further illustrates the positioning and engagement of the force-transfer element 77, the pin 81, and the spring 83 when force is applied to the trigger 72. FIG. 16*c* is a view of section H-H' of FIG. 16*a* and further illustrates the positioning and engagement of the telescoping member's force-transfer element 77, the second pin 85, and the second spring 87 when force is applied to the trigger 72 when the telescoping member's force-transfer element 77 is positioned to engaged the second pin 85.

Figure 17:
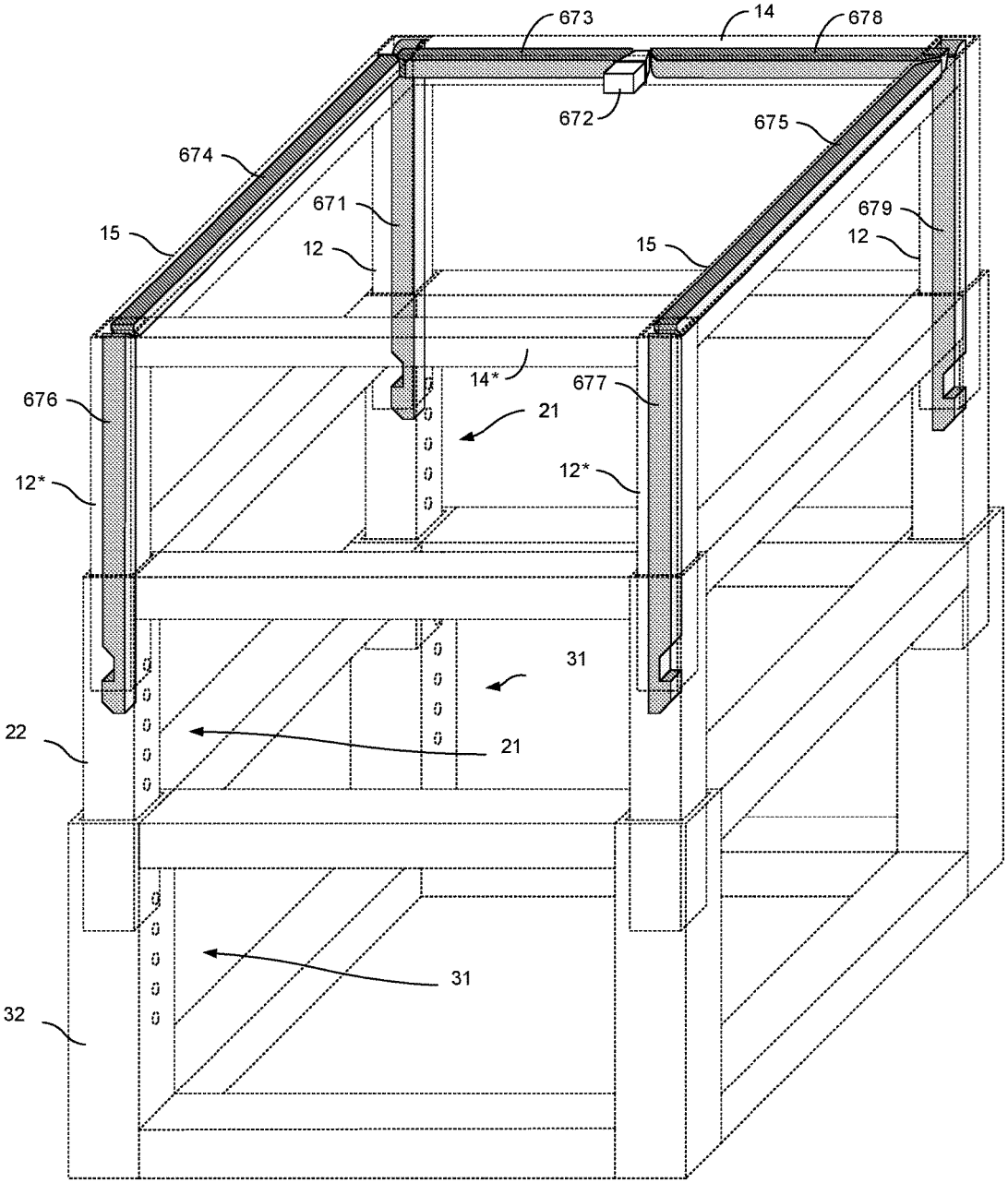
FIG. 17 is a perspective view illustrating an exemplary embodiment of a detent-control assembly disposed within a configurable container-support frame in an extended position.

Another exemplary embodiment of a detent-control assembly for a configurable container-support frame is shown in FIG. 17. The detent-control assembly is illustrated as disposed within the frame of FIG. 1 in an extended position. The frame is depicted as if invisible as denoted by the dotted lines. This embodiment is structured and functions similarly to the embodiment of FIG. 12 except that there is no central cross member. Instead, a trigger 672 and two force-transfer elements 673, 678 are positioned in a first cross member 14. Two more force-transfer elements 674, 675 are positioned in the frame, one in each opposing cross member 15 that is adjacent to a telescoping member 12 that is also adjacent to the first cross member 14. Four more force-transfer elements 671, 676, 677, 679 are positioned in the frame, one in each of the first section's telescoping members 12, 12*.

The trigger 672 is shaped such that when it is pushed into first cross member 14 it engages the ends of two force-transfer elements 673, 678 disposed within the first cross member 14 on either side of the trigger 672. The end of each of the first cross member's force-transfer elements 673, 678 that is nearest to the trigger 672 is shaped such that when engaged with the trigger 672, the force applied to the trigger 672 causes the first cross member's force-transfer elements 673, 678 to move along and within the first cross member 14 away from the trigger 672.

The end of each of the first cross member's force-transfer elements 673, 678 that is farthest from the trigger 672 is shaped such that when the force-transfer element 673, 678 is pushed away from the trigger 672 it engages the end of the corresponding opposing cross members' force-transfer element 674, 675 and, at the same time, engages the end of the corresponding telescoping member's force-transfer element 671, 679 that is positioned in each of the two telescoping members 12 adjacent to the first cross member 14. The end of each the opposing cross members' force-transfer elements 674, 675 that is nearest to the corresponding first cross member's force-transfer element 673, 678 is shaped such that when that when engaged with the corresponding first cross members' force-transfer element 673, 678, the force applied to the first cross member's force-transfer elements 673, 678 through the trigger 672 causes the opposing cross members' force-transfer elements 674, 675 to move along and within the opposing cross members 15 away from the first cross member's force-transfer elements 673, 678.

The end of each of the adjacent telescoping members' force-transfer elements 671, 679 that is nearest to the corresponding first cross member's force-transfer element 673, 678 is shaped such that when engaged with the corresponding first cross member's force-transfer element 673, 678, the force applied to the first cross member's force-transfer elements 673, 678 through the trigger 672 causes the adjacent telescoping members' force-transfer elements 671, 679 to move along and within the adjacent telescoping members 12 away from the first cross member's force-transfer elements 673, 678.

The end of each of the opposing cross members' force-transfer elements 674, 675 that is farthest from the corresponding first cross member's force-transfer element 673, 678 is shaped such that when the opposing cross members' force-transfer elements 674, 675 are pushed away from the corresponding first cross member's force-transfer element 673, 678, each engages the ends of a force-transfer element 676, 677 disposed within each of the first section's telescoping members 12* that are distant to the first cross member 14 (i.e., not adjacent to the first cross member). As each of the opposing cross members' force-transfer elements 674, 675 move along and within the opposing cross members 15 away from the first cross member's force-transfer elements 673, 678, the opposing cross members' force-transfer elements 674, 675 force the distant telescoping members' force-transfer elements 676, 677 to move along and within the first section's indirectly attached telescoping members 12* away from opposing cross members' force-transfer elements 674, 675. As oriented in FIG. 17, force applied to the trigger 672 causes the telescoping members' force-transfer elements 673, 676, 677, 678 to move downward.

The telescoping members' force-transfer elements 673, 676, 677, 678 are configured to engage and position detent pins and springs as is described above with reference to FIGS. 13*a*, 13*b*, 13*c*, 14*a*, 14*b*, 14*c*, 15*a*, 15*b*, 15*c*, 16*a*, 16*b*, 16*c* for the telescoping members' force-transfer elements 77, 78 of the embodiment of FIG. 12.

Figure 18:
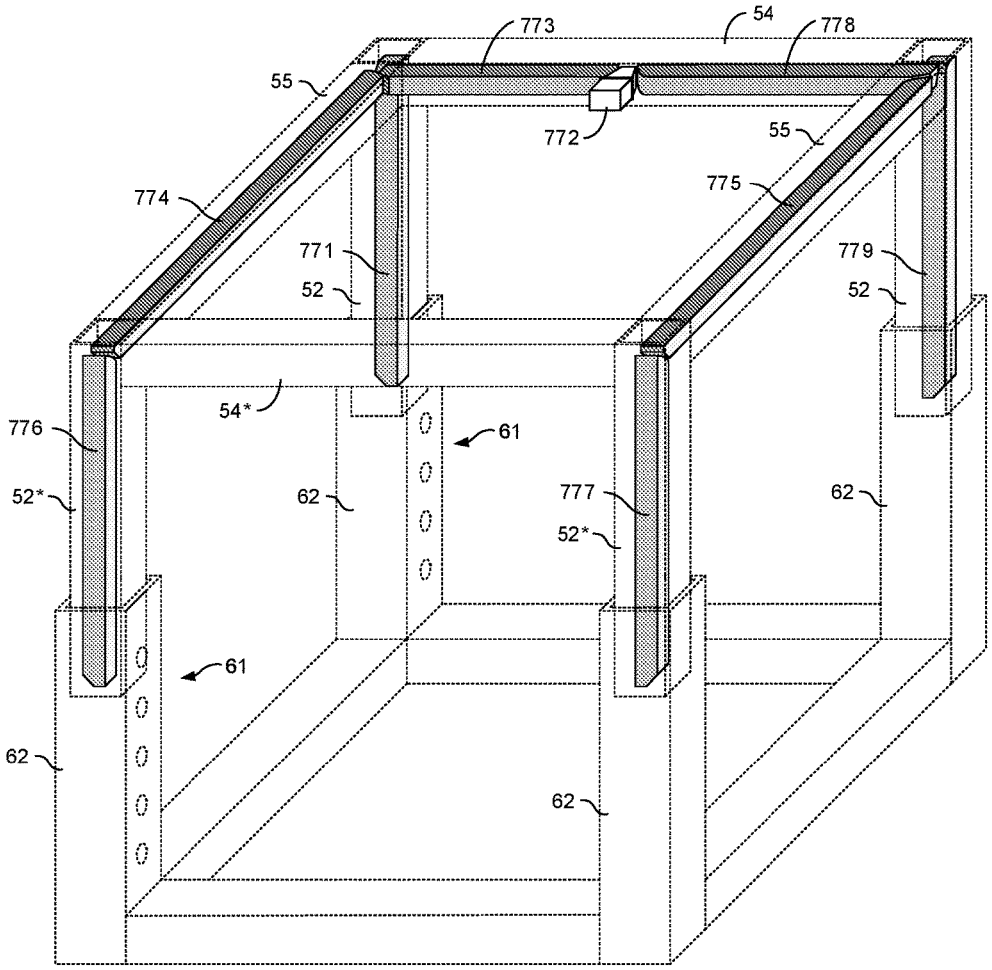
FIG. 18 is a perspective view illustrating an exemplary embodiment of a detent-control assembly disposed within a configurable container-support frame in an extended position.

Another exemplary embodiment of a detent-control assembly for a configurable container-support frame is shown in FIG. 18. The detent-control assembly is illustrated as disposed within the frame of FIG. 7 in an extended position. The frame is depicted as if invisible as denoted by the dotted lines. This embodiment is structured and functions similarly to the embodiment of FIG. 17 except that there are only two sections to the frame. A trigger 772, first cross members' force-transfer elements 773, 778, opposing cross members' force-transfer elements 774, 775, and telescoping members' force-transfer elements 771, 776, 777, 779 are configured to engage and position in response to a force applied to trigger 772 as is described above for the trigger 672, first cross members' force-transfer elements 673, 678, opposing cross members' force-transfer elements 674, 675, and telescoping members' force-transfer elements 671, 676, 677, 679 for the detent-control assembly of the embodiment of FIG. 17. The only difference is that the telescoping members' force-transfer elements 771, 776, 777, 779 of the embodiment of FIG. 18 are configured to engage a single set of detent pins and springs.

Figure 19:
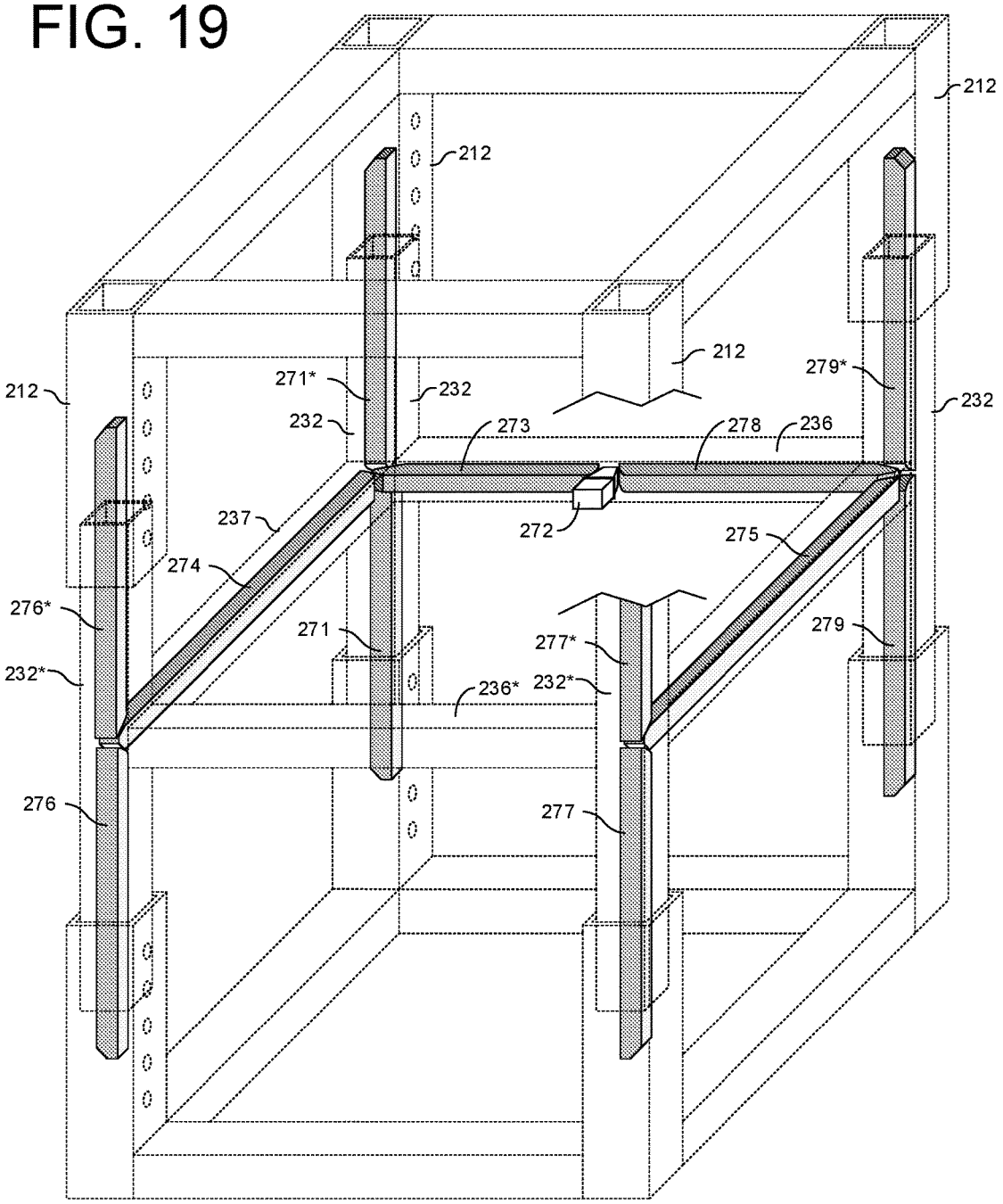
FIG. 19 is a perspective view illustrating an exemplary embodiment of a detent-control assembly disposed within a configurable container-support frame in an extended position.

Another exemplary embodiment of a detent-control assembly for a configurable container-support frame is shown in FIG. 19. The detent-control assembly is illustrated as disposed within the frame of FIG. 5 in an extended position. This embodiment is structured and functions similarly to the embodiment of FIG. 18 except that there are force-transfer elements extending in the third section's telescoping members 232, 232* in both directions away from the plane defined by the third section's cross members 236, 236*, 237. In FIG. 19, one set of the telescoping member's force-transfer elements 271, 276, 277, 279 are show directed downward, the other set of the telescoping member's force-transfer elements 271*, 276*, 277*, 279* are shown directed upward. The frame is depicted as if invisible as denoted by the dotted lines. And one of the first section's telescoping members 212 and one of the upward-directed telescoping members' force-transfer elements 277* are shown partially removed from the figure for the sake of better viewing the trigger 272. This embodiment may be configured as two detent-control assemblies according to FIG. 18, each operating independently with one controlling the detents positioned in the third section's telescoping members 232, 232* as nested with the first section's telescoping members 212 and the other controlling the detents positioned in the third section's telescoping members 232, 232* as nested with the second section's telescoping members 222. Alternatively, as shown in FIG. 19, each of the first cross member's force-transfer elements 773, 778 of FIG. 18 may be replaced with force-transfer elements 273, 278 that are each shaped to engage two corresponding force-transfer elements, 271, 271*, 279, 279* positioned in the third section's telescoping members 232 adjacent to the first cross member 236 at the same time the first cross member's force-transfer elements 273, 278 engage the opposing cross members' transfer elements 274, 275. And the opposing cross members' force-transfer elements 774, 775 of FIG. 18 may be replaced with force-transfer elements 274, 275 that are each shaped to engage two corresponding force-transfer elements, 276, 276*, 277, 277* positioned in the third section's telescoping members 232* that are distant to the first cross member 236. As oriented in FIG. 19, force applied to the trigger 272 causes the upward-directed telescoping members' force-transfer elements 271*, 276*, 277*, 279* to move upward and the downward-directed telescoping members' force-transfer elements 271, 276, 277, 279 to move downward.

The embodiments illustrated in FIGS. 12, 17, 18, and 19 depict a trigger that cause the various force-transfer elements to move when pushed. Optionally, a trigger that cause the various force-transfer elements to move when the trigger is pulled or rotated may be used. For example, a rotating trigger may include an oblong part that has its long dimension perpendicular to the force-transfer elements positioned in the cross member holding the trigger when the assembly is in the relaxed position and that can be rotated so that the long dimension is parallel to the force transfer elements, thereby forcing the force-transfer elements away from the trigger.

Figure 20A:
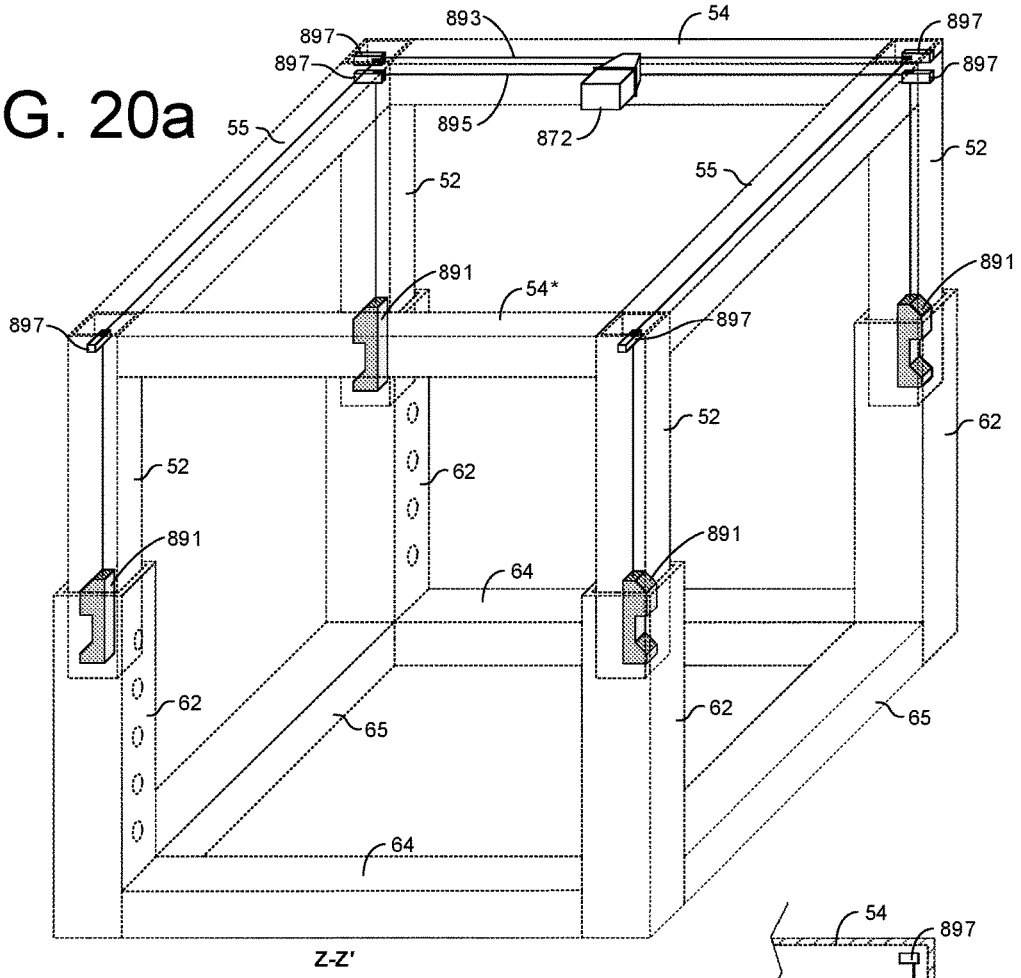
FIG. 20*a* is a perspective view illustrating an exemplary embodiment of a detent-control assembly disposed within a configurable container-support frame in an extended position.
Figure 20B:
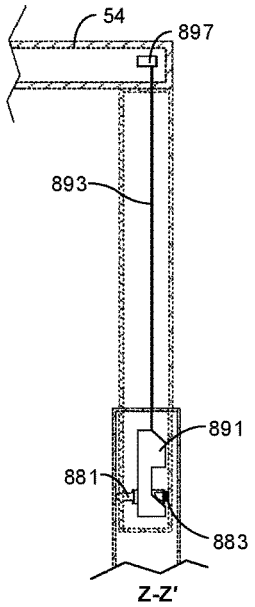
FIG. 20*b* is a side section view illustrating an exemplary embodiment of nested telescoping members with a cable controlled detent actuator.

Another exemplary embodiment of a detent-control assembly for a configurable container-support frame is shown in FIGS. 20*a* and 20*b*. The detent-control assembly is illustrated as disposed within the frame of FIG. 7 in an extended position. The frame is depicted as if invisible as denoted by the dotted lines. In this embodiment, force is transferred from the trigger 872 positioned on a first cross member 54 to the detent pins 881 and detent springs 883 positioned in the telescoping members 52 by positioning detent actuators 891 in the telescoping members 52 using cables 893, 895. The cables 893, 895 are positioned along the path from the trigger to the detent actuators 891 using pulleys or pins 897 over which the cables 893, 895 run and which change the direction of the cable path. The cables 893, 895 are positioned so that the force on the trigger 872 will lengthen the path followed by the cables 893, 895 and detent actuators 891 to reach the detent pin 881, thereby causing the detent actuators 891 to move along the cable path toward the trigger 872. As the detent actuators 891 move along the cable path toward the trigger, they engage the detent pins 881 and compress the detent springs 883, causing the detent pins 881 to withdraw from the holes in the second section's telescoping members 62. FIG. 20*b* is a view of a portion of face Z-Z' of FIG. 20*a* with detents in the released position. As oriented in FIG. 20*b*, force applied to the trigger 872 causes cables to pull the detent actuator 891 upward to engage the detent pin 881, compress the detent spring 883, and withdraw the pin 881 from the holes the second section's telescoping members 62.

The two cables of the illustrated embodiment may be replaced with four cables, each one connecting the trigger to a distinct detent actuator. And any of the illustrated embodiment's contiguous cables may be replaced with an assembly comprising rigid and flexible elements that engage the trigger and the detent actuator such that activating the trigger changes the length of the path the assembly follows from the trigger to the detent pin. Further, a trigger need not be activated by pushing. For example, a trigger may be activated by pulling or rotating so long as activating the trigger changes the length of the path followed by the cable and detent actuators to reach the detent pin. An example of a rotating trigger is a spool: cables may be attached to a spool such that rotating the trigger will wind the spool and draw the detent actuators into position. Another example of a rotating trigger would be an oblong part that has its long dimension parallel to the cables in the relaxed position and that can be rotated so that the long dimension is perpendicular to the cables, thereby perturbing the cables to draw the actuators into position.

Figure 20C:
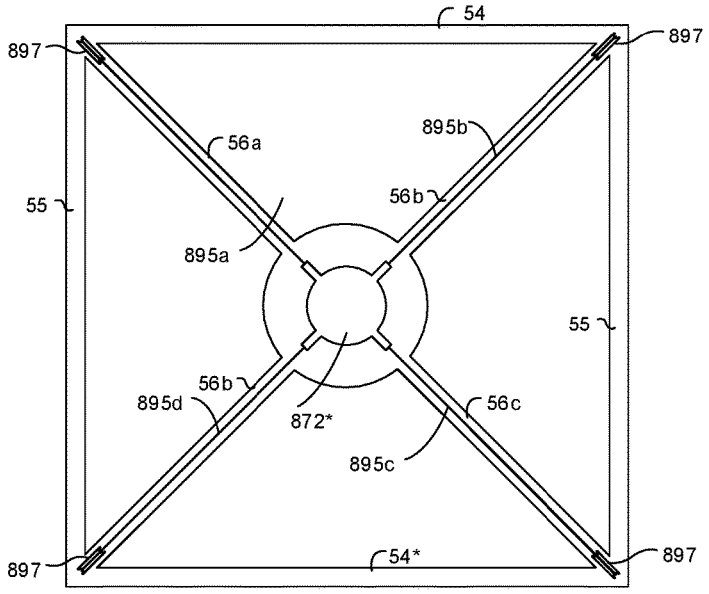
FIG. 20*c* is a top section view illustrating an exemplary embodiment of a detent-control assembly disposed within a configurable container-support frame.

Another exemplary embodiment of a detent-control assembly for a configurable container-support frame is shown in FIG. 20*c*. The figure depicts a top sectional view of a configurable container support frame similar to that depicted in FIG. 7. The embodiment includes additional cross-members 56*a*, 56*b*, 56*c*, 56*d*, each cross member having a cable 895*a*, 895*b*, 895*c*, 895*d* disposed within. Each cable 895*a*, 895*b*, 895*c*, 895*d* is attached at one end to a detent actuator 891, as described with reference to FIGS. 20*a* and 20*b*, and at the other end to a spool trigger 872*. When rotated, the spool trigger 872* causes the cables 895*a*, 895*b*, 895*c*, 895*d* to move such that detent actuators 891 are drawn into position to engage the detent pins 881, compress the detent spring 883, and withdraw the pin 881 from the holes the second section's telescoping members 62. The spool trigger 872* is depicted in FIG. 20*c* in the relaxed position, such that detent actuators 891 are not engaging the detent pins 881.

Figure 20D:
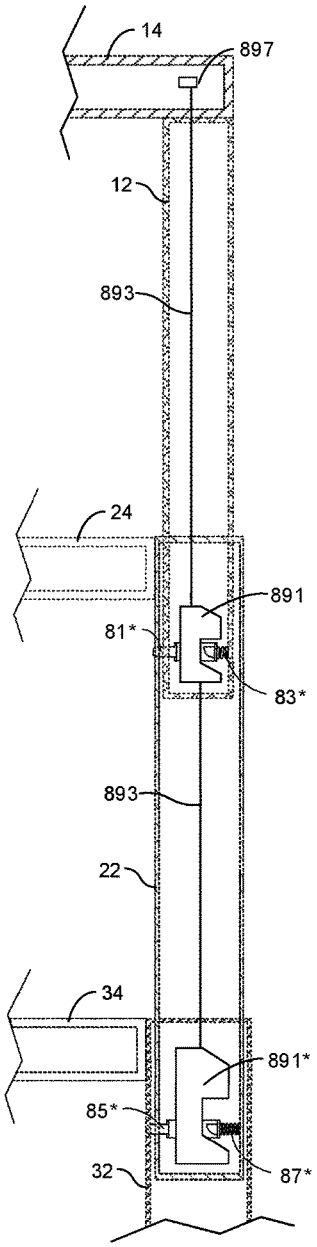
FIG. 20*d* is a side section view illustrating an exemplary embodiment of nested telescoping members with cable controlled detent actuators configured to engage two detents.

FIG. 20*d* depicts a cable assembly with multiple actuators 891, 891* per cable 893. The assembly is shown disposed in one set of the nested telescoping members 12, 22, 32 described with reference to FIGS. 1-2*b*. A lower actuator 891* is configured to engage a lower detent pin 85* and an upper actuator 891 is configured to engage an upper detent pin 81*. When the cable 893 is drawn up within the telescoping members 12, 22, 32, the upper and lower actuators 891, 891* will engage the upper and lower detent pins 81*, 85* respectively. The actuators 891, 891* may be spaced such that the upper actuator 891 engages the upper detent pin 81* at substantially the same moment the lower actuator 891* engages the lower detent pin 85*. Thus, all detents in a three-section support frame such as depicted in FIG. 2*a* would be released at substantially the same moment using a single trigger. Alternatively, the actuators 891, 891* may be spaced such that the lower actuator 891* engages the lower detent pin 85* without the upper actuator 891 engaging the upper detent pin 81*. The cable 893 may then be further drawn up such that the upper actuator 891 engages the upper detent pin 81*. Thus, each lower detent in a three-section support frame such as shown in FIG. 2*a* could be released at substantially the same moment using a single trigger while each upper detent remains in a locked position. This allows the middle section 20 of the frame and the lower section 30 of the frame to move relative to each other while the middle section 20 and the upper section 10 remain fixed in position relative to each other. Then, the upper detents may be released, also freeing the upper section 10 and middle section 20 to move relative to each other.

In another embodiment, a separate trigger/cable system may independently control each set of detents. This can be understood with reference to FIG. 2*a*. The set of detents that are used to lock the lower section 30 to the middle section 20 may be controlled through a first trigger. And the set of detents that are used to lock the middle section 20 to the upper section 10 may be independently controlled through a second trigger.

An embodiment of a wheeled configurable container-support frame is shown in FIGS. 21, 22, 23*a*, 23*b*, 23*c*, 24*a*, 24*b*, 25*a*, 25*b*, 25*c*, and 25*d*. This embodiment is similar to the embodiment of FIG. 9.

Figure 21:
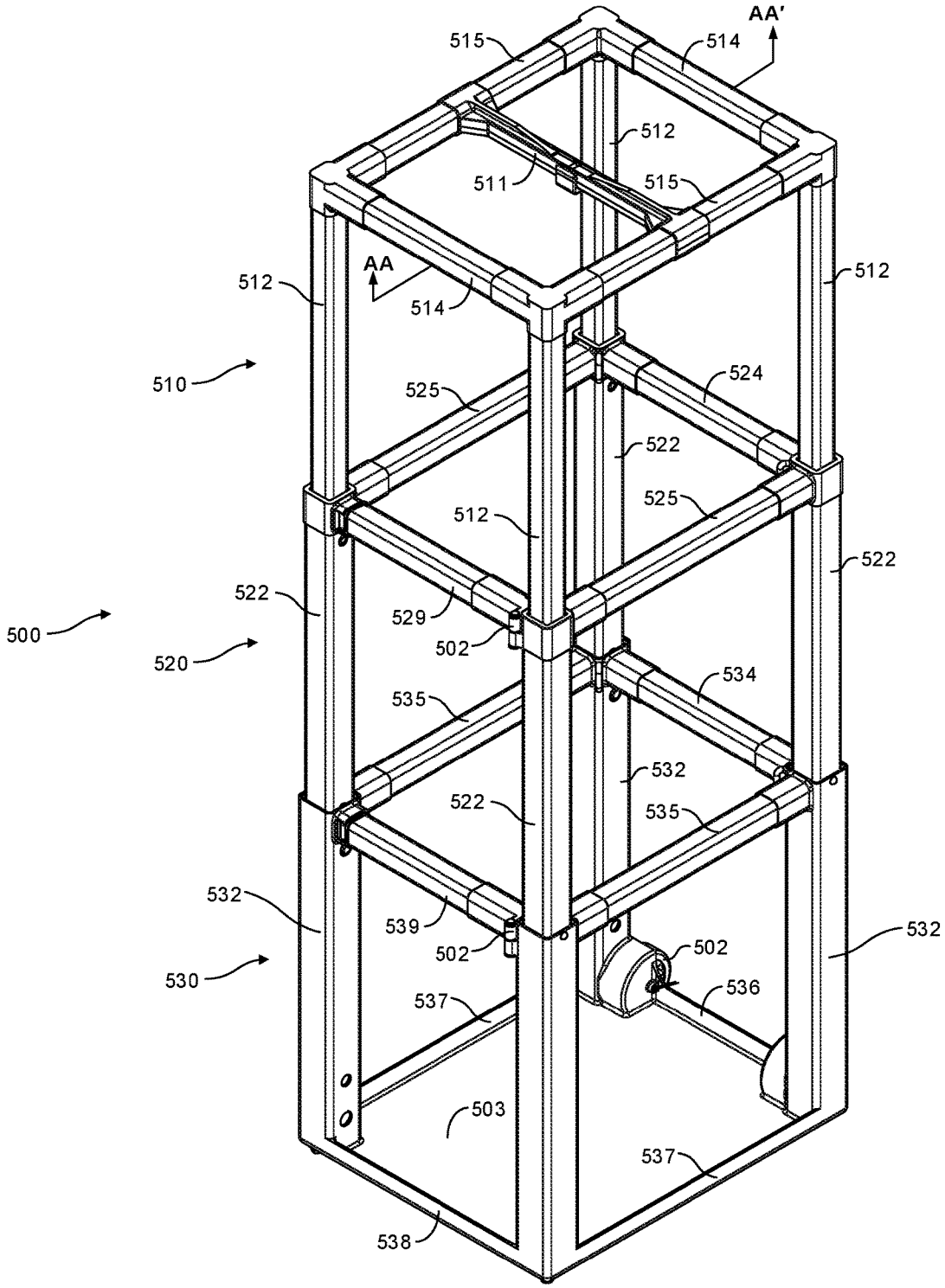
FIG. 21 is a perspective view illustrating an exemplary embodiment of a wheeled configurable container-support frame in an extended position.

As shown FIG. 21, the frame includes three sections, 510, 520, 530. Each section includes four telescoping members 512, 522, 532 oriented substantially parallel to each other. Each section 510, 520, 530 further includes four cross members 514, 515, 524, 525, 529, 534, 535, 539. One section 530 of the frame serves as a base section and further includes an additional four cross members 536, 537, 538. The additional four cross members 536, 537, 538 may optionally be integral portions of a base 503. Wheels 502 are attached to one of the additional four cross members 536.

Similar to the embodiment of FIG. 9, each cross member 514, 515, 524, 525, 529, 534, 535, 539 connects a pair of telescoping members 512, 522, 532. In a first section 510, each telescoping member 512 is connected to two other telescoping members 512—to the first other telescoping member 512 through a first cross member 514 and to the second other telescoping member 512 through a second cross member 515. The first section further includes a central cross member 511 spanning opposing cross members 515. In a second section 520, each telescoping member 522 is connected to two other telescoping members 522—to the first other telescoping member 522 through a first cross member 524 that is fixed in position or through a first cross member 529 that is removable but attached via a hinge 502 and to the second other telescoping member 522 through a second cross member 525. In a third section 530, each telescoping member 532 is connected to two other telescoping members 532—to the first other telescoping member 532 through a first cross member 534 that is fixed in position or through a first cross member 539 that is removable but attached via a hinge 502 and to the second other telescoping member 532 through a second cross member 535. The third section 530 of the exemplary frame serves as a base section and each telescoping member 532 is further connected to the two other telescoping members 532 through third and fourth cross members 536, 537, 538—to the first other telescoping member 532 through a third cross member 536 that is attached to wheels or a third cross member 538 and to the second other telescoping member 532 through a fourth cross member 537.

The telescoping members 512, 522, 532 are "telescoping" in that the telescoping members of one section fit in or over ("nest with") the telescoping members of another section such that the nested telescoping members can move relative to each other with one telescoping member sliding within the other telescoping member. The telescoping members 512, 522, 532 are oriented "substantially parallel" to each other in that when the telescoping members of one section are nested with the telescoping members of another section, the sections can move relative to each other with the telescoping members of one section sliding within the telescoping members of the other section. The cross members are "substantially perpendicular" to the telescoping members to which they are attached in that they are attached to allow the nested sections to move relative to each other with the telescoping members of one section sliding within the telescoping members of the other section. The frame sections may be positioned relative to each other by sliding the telescoping members of one section further into or out of the telescoping members that they are nested with.

Figure 22:
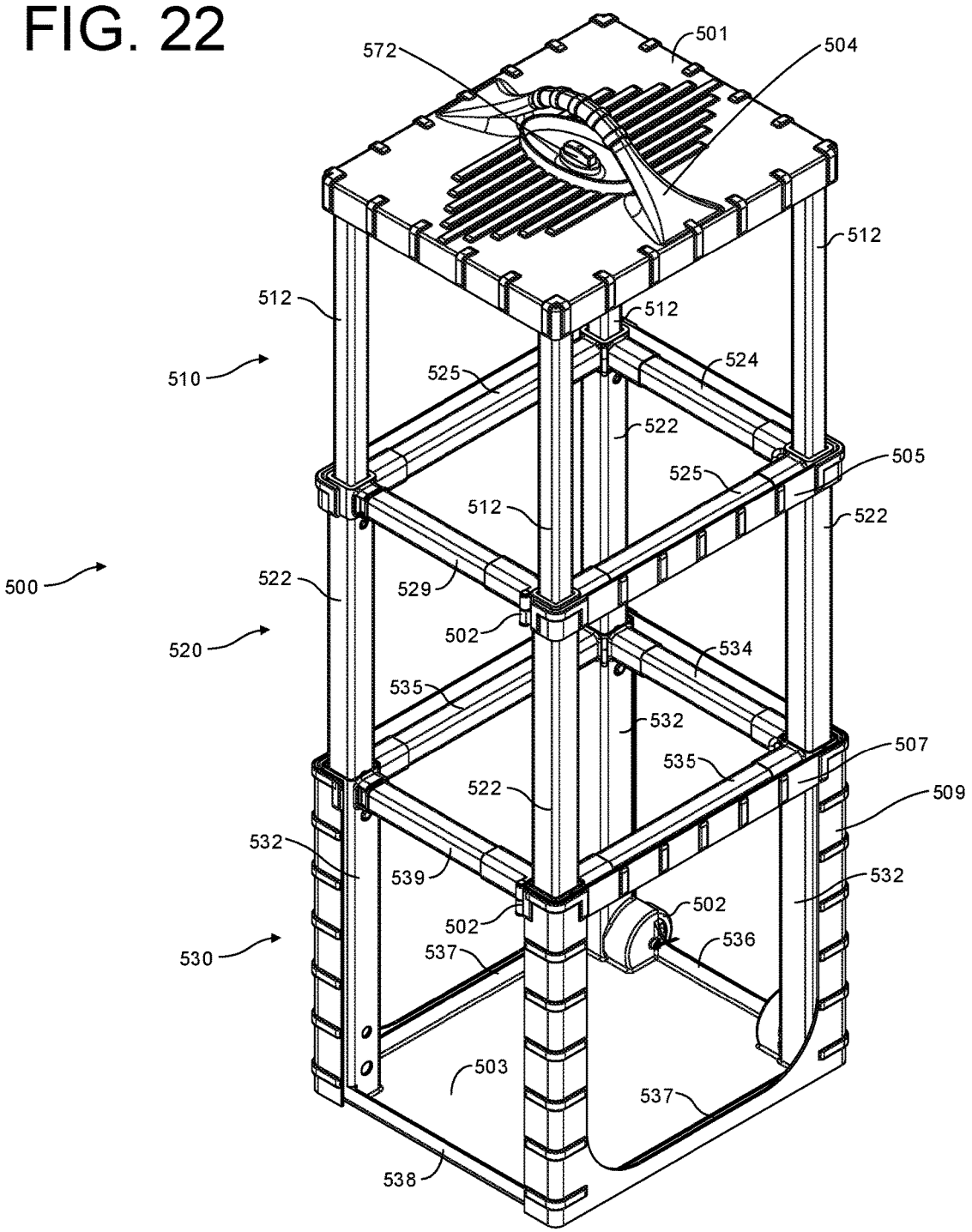
FIG. 22 is a perspective view illustrating view of an exemplary embodiment of a wheeled configurable container-support frame in an extended position.

As shown in FIG. 22, that frame may include a top 501 with an integrated handle 504. It may also include bumpers 505, 507, 509 attached to the outside of a surface (not shown) disposed around the telescoping members 512, 522, 532 and the cross members 514, 515, 524, 525, 529, 534, 535, 536, 537, 538, 539. The top 501 and base 503 may be integral portions of the surface, or may be disposed outside or within the surface.

Figure 23A:
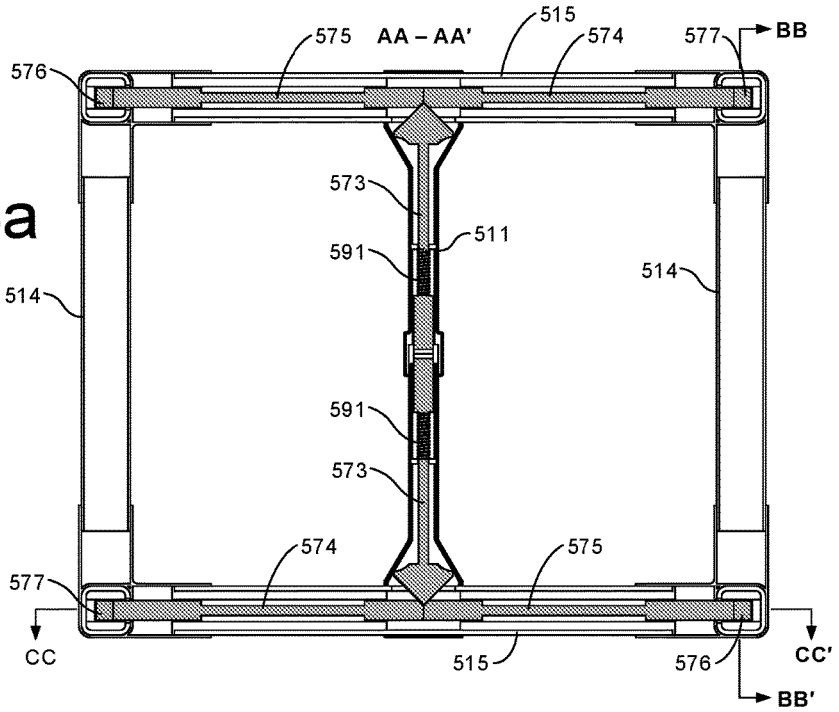
FIGS. 23*a*, 23*b*, and 23*c* illustrate an exemplary embodiment of a detent-control assembly disposed within a wheeled configurable container-support frame in an extended position.
Figure 23B:
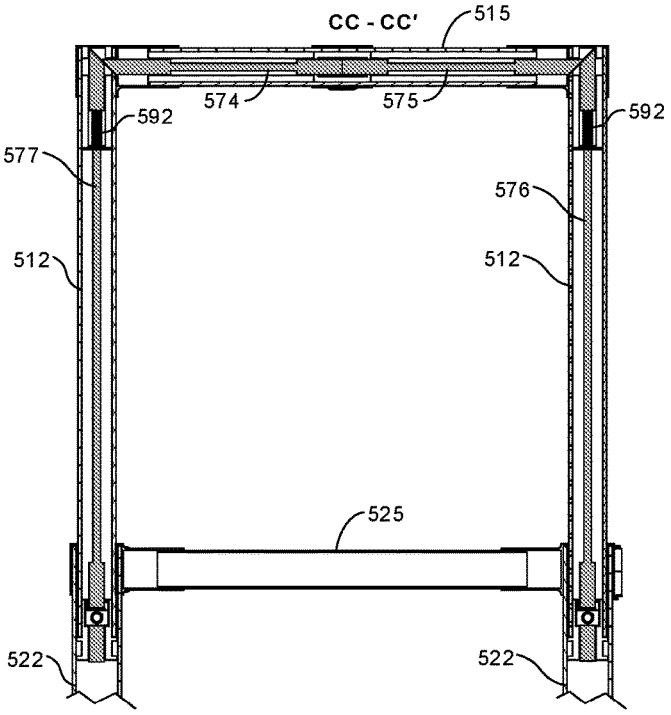
Figure 23C:
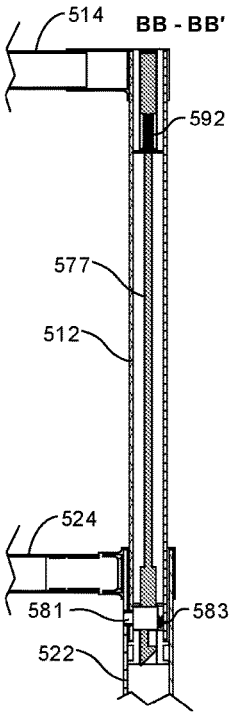

Control of the relative positions of the frame sections, and thereby of the volume of the frame, is effected through a trigger 572 in communication with a series of force-transfer elements in a manner similar to the embodiment of FIG. 12. As shown in FIG. 23*a*, a view of section AA-AA' of FIG. 21, the trigger 572 engages force-transfer elements 573 positioned in the central cross member 511. The central cross member's force transfer elements 573 engage with corresponding force-transfer elements 574, 575 positioned in opposing cross members 515. As shown in FIG. 23*b*, the opposing cross members' force-transfer elements 574, 575 engage with corresponding force-transfer elements 576, 577 positioned in the first section's telescoping members 512. As shown in FIG. 23*c*, the telescoping members' force-transfer elements 576, 577 engage with a corresponding detent pin 581 and detent spring 583 positioned in each of the first section's telescoping members 512. As illustrated in FIG. 23*a*, the detent-control assembly optionally includes springs 591 to help return the central cross member's force transfer elements 573 to the relaxed position when no force is applied to the trigger 572. As illustrated in FIG. 23*b*, the detent-control assembly optionally includes springs 592 to help return the opposing cross members' force-transfer elements 574, 575 and the telescoping members' force-transfer elements 576, 577 to the relaxed position when no force is applied to the trigger 572.

In a manner analogous to that described with respect to FIG. 12, when force is applied to the trigger 572, it causes the central cross member's force-transfer elements 573 to move along and within the central cross member 511 away from the trigger 572 which in turn causes the opposing members' force-transfer elements 574, 575 to move along and within the opposing cross members 515 away from central cross member's force-transfer elements 573 which in turn causes the telescoping members force-transfer elements 576, 577 to move along and within the first section's telescoping members 512 away from the opposing members' force-transfer elements 574, 575. As oriented in FIGS.

23*b* and 23*c*, force applied to the trigger 572 causes the telescoping members' force-transfer elements 576, 577 to move downward.

Figure 24A:
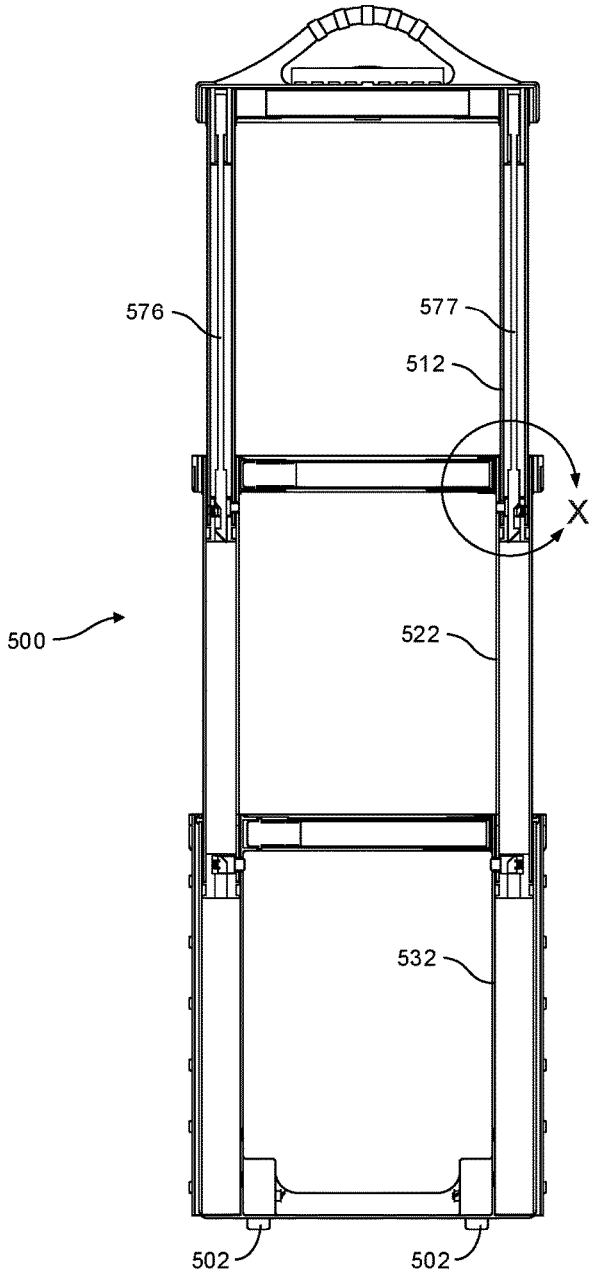
FIG. 24*a* is an elevation view illustrating an exemplary embodiment of a detent assembly disposed within a wheeled configurable container-support frame in an extended position.
Figure 24B:
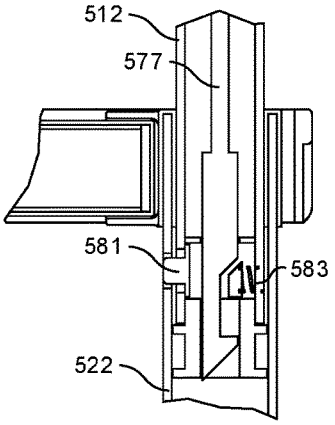
FIG. 24*b* is a detailed view illustrating a portion of an exemplary embodiment of a detent assembly disposed within a wheeled configurable container-support frame in an extended position.
Figure 25A:
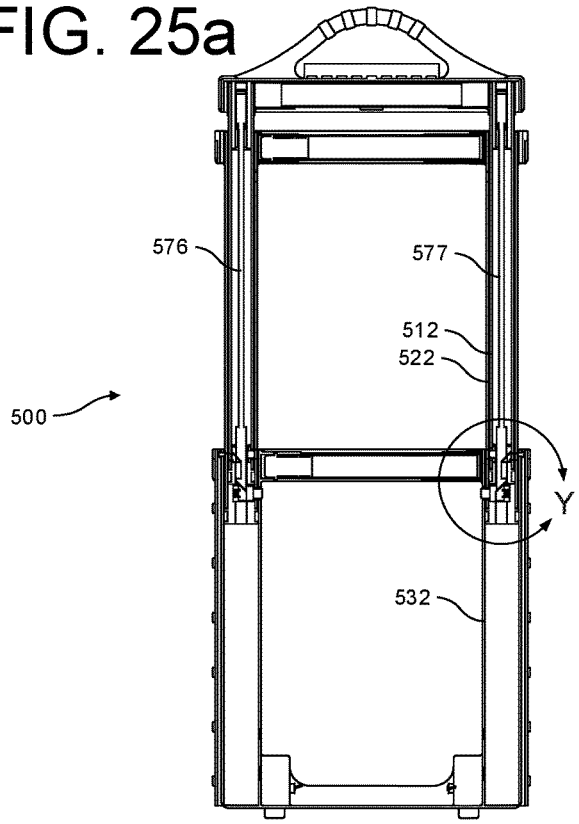
FIG. 25*a* is an elevation view illustrating an exemplary embodiment of a detent assembly disposed within a wheeled configurable container-support frame in a partially extended position.
Figure 25B:
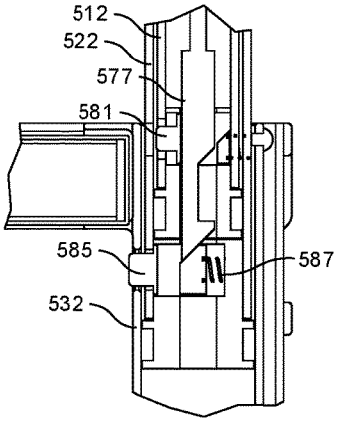
FIG. 25*b* is a detailed view illustrating a portion of an exemplary embodiment of a detent assembly disposed within a wheeled configurable container-support frame in an extended position.

In a manner analogous to that described with respect to FIGS. 13*a*, 13*b*, 13*c*, 14*a*, 14*b*, 14*c*, 15*a*, 15*b*, 15*c*, 16*a*, 16*b*, 16*c*, when the telescoping members' force-transfer elements 576, 577 move downward to engage detent pins 581 and detent springs 583 positioned in first section's telescoping members 512, the springs 583 compress and the pins 581 are withdrawn from the holes in the second section's telescoping members 522. Thus, a force applied to trigger 572 releases the first section's telescoping members 512 to slide within the second section's telescoping members 522 with which they are nested. In FIG. 24*a*, the exemplary frame is shown locked in an extended position. FIG. 24*b* shows the detail of the detent pin 581 and detent spring 583 in the locked position. In FIG. 25*a*, the exemplary frame is shown with the first section's telescoping members 512 released to slide within the second section's telescoping members 522 with which they are nested. FIG. 25*b* shows the detail of the detent pin 581 and detent spring 583 in the released position.

Figure 25C:
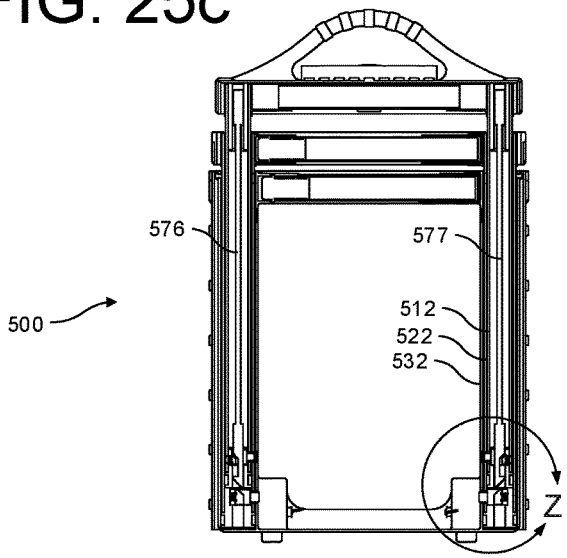
FIG. 25*c* is an elevation view illustrating an exemplary embodiment of a detent assembly disposed within a wheeled configurable container-support frame in a fully collapsed position.
Figure 25D:
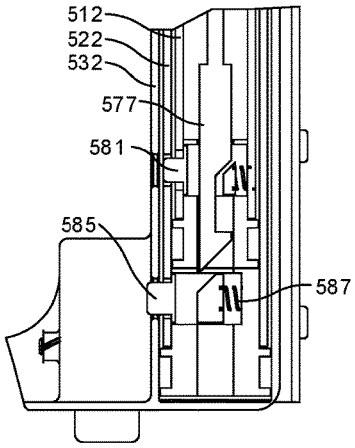
FIG. 25*d* is a detailed view illustrating a portion of an exemplary embodiment of a detent assembly disposed within a wheeled configurable container-support frame in a fully collapsed position.

In a manner analogous to that described with respect to FIGS. 15*a*, 15*b*, 15*c*, 16*a*, 16*b*, 16*c*, the first section's telescoping members 512 may be positioned in the second section's telescoping members 522 with which they are nested such that the telescoping members' force-transfer elements 576, 577 engage second detent pins 585 and second detent springs 587 that are positioned within the second section's telescoping members 522. In this position, when the telescoping members' force-transfer elements 576, 577 move downward to engage the second detent pins 585 and the second detent springs 587 positioned in the second section's telescoping members 522, the springs 587 compress and the pins 585 are withdrawn from the holes in the third section's telescoping members 532. Thus, a force applied to trigger 572 releases the second section's telescoping members 522 to slide within the third section's telescoping members 532 with which they are nested. In FIG. 25*a*, the exemplary frame is shown with the first section's telescoping members 512 released to slide within the second section's telescoping members 522 with which they are nested and the second section's telescoping members 522 locked in position relative to the third section's telescoping members 532 with which they are nested. FIG. 25*b* shows the detail of the second detent pin 585 and second detent spring 587 in the locked position. In FIG. 25*c*, the exemplary frame is shown in a fully collapsed position, with the first section's telescoping members 512 locked in position relative to the second section's telescoping members 522 with which they are nested and the second section's telescoping members 522 locked in position relative to the third section's telescoping members 532 with which they are nested. FIG. 25*d* shows the detail of the a first detent pin 581 and the first detent spring 583 in the locked position and the second detent pin 585 and second detent spring 587 in the locked position While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A configurable container-support frame comprising:

(a) a first frame section comprising:

(i) at least three telescoping members, wherein each telescoping member is substantially parallel to each other telescoping member, and (ii) at least three cross members, wherein each cross member connects to two different telescoping members and wherein each cross member is substantially perpendicular to each telescoping member to which it connects;

(b) a second frame section comprising:

(i) at least three telescoping members, wherein each telescoping member is substantially parallel to each other telescoping member, and (ii) at least three cross members, wherein each cross member connects to two different telescoping members and wherein each cross member is substantially perpendicular to each telescoping member to which it connects, (iii) wherein each telescoping member of the second frame section is nested with a telescoping member of the first frame section thereby forming pairs of nested telescoping members;

(c) at least three detents, each detent comprising a pin and a spring, wherein each detent is disposed within a different telescoping member such that each of the pairs of nested telescoping members includes at least one detent and wherein each detent is configured to selectively engage one of the pairs of telescoping members thereby locking the relative positions of the telescoping members of the pair of telescoping members; and (d) a detent-release mechanism comprising:

(i) a single trigger, and (ii) at least three detent-actuators, wherein each detent-actuator is disposed such that each pair of nested telescoping members includes at least one detent-actuator and wherein each detent-actuator is configured to selectively engage a detent, and (iii) at least three force-transfer elements, wherein each force-transfer element is disposed to effect mechanical communication between the trigger and at least one of the three detent-actuators such that if a force is applied to the trigger the force will be communicated to each detent-actuator.

2. The configurable container-support frame of claim 1 wherein the at least three force-transfer elements are cables.

3. The configurable container-support frame of claim 2 wherein the trigger is a spool.

4. The configurable container-support frame of claim 1 wherein the at least three force-transfer elements are rods.

5. The configurable container-support frame of claim 4 wherein the rods are flexible.

6. The configurable container-support frame of claim 1 further comprising:

(a) a third frame section comprising:

(i) at least three telescoping members, wherein each telescoping member is substantially parallel to each other telescoping member, and (ii) at least three cross members, wherein each cross member connects to two different telescoping members and wherein each cross member is substantially perpendicular to each telescoping member to which it connects, (iii) wherein each telescoping member of the third frame section is nested with a telescoping member of the second frame section thereby forming pairs of nested telescoping members; and (b) at least three additional detents, each additional detent comprising a pin and a spring, wherein each additional detent is disposed within a different telescoping member such that each of the pairs of nested telescoping members formed by the third frame section and the second frame section includes at least one of the additional detents and wherein each of the additional detents is configured to selectively engage one of the pairs of telescoping members formed by the third frame section and the second frame section thereby locking the relative positions of the telescoping members of the pair of telescoping members formed by the second frame section and the third frame.

7. The configurable container-support frame of claim 6, the detent-release mechanism further comprising:

(a) at least three additional detent-actuators, wherein each additional detent-actuator is disposed such that each pair of nested telescoping members formed by the third frame section and the second frame section includes at least one of the additional detent-actuators and wherein each additional detent-actuator is configured to selectively engage at least one of the additional detents; and (b) wherein each force-transfer element is disposed to effect mechanical communication between the trigger and at least one of the three additional detent-actuators such that if a force is applied to the trigger the force will be communicated to each additional detent-actuator.

8. The configurable container-support frame of claim 6, the detent-release mechanism further comprising:

(a) a second trigger, (b) at least three additional detent-actuators, wherein each additional detent-actuator is disposed such that each pair of nested telescoping members formed by the third frame section and the second frame section includes at least one of the additional detent-actuators and wherein each additional detent-actuator is configured to selectively engage at least one of the additional detent, and (c) at least three additional force-transfer elements, wherein each force-transfer element is disposed to effect mechanical communication between the second trigger and at least one of the three additional detent-actuators such that if a force is applied to the second trigger the force will be communicated to each additional detent-actuator.

9. A configurable container-support frame comprising:

(a) at least three nested pairs of telescoping members, each nested pair of telescoping members comprising:

(i) a first telescoping member, (ii) a second telescoping member, wherein the second telescoping member fits within the first telescoping member, (iii) a detent, wherein the detent is configured to selectively engage the first telescoping member and the second telescoping member and thereby prevent the first telescoping member from moving with respect to the second telescoping member, and (iv) a detent actuator, wherein the detent actuator is configured to selectively engage the detent and thereby cause the detent to disengage the first telescoping member and the second telescoping member, and (b) at least six cross members, each cross member disposed to connect two of the nested pairs of telescoping members;

(c) a detent-actuator-control means for selectively positioning the detent actuator to engage the detent, for each of the nested pairs of telescoping members.

10. A configurable container-support frame comprising:

(a) at least two frame sections, each frame section comprising:

(i) at least three telescoping members, wherein each telescoping member is substantially parallel to each other telescoping member, and (ii) at least three cross members, wherein each cross member connects to two different telescoping members and wherein each cross member is substantially perpendicular to each telescoping member to which it connects, (iii) wherein each telescoping member of one frame section is nested with one telescoping member of at least one other frame section, and (b) at least three detents, each comprising a pin and a spring, wherein each detent is disposed within a different telescoping member such that each pair of nested telescoping members includes at least one detent, whereby each telescoping member may be selectively locked in position relative to the telescoping member with which it is nested, and (c) a detent-release means for compressing each detent spring disposed in the nested pairs of telescoping members connecting one frame section to another frame section.

* * * * *